United States Patent [19]

Gombas

[11] 4,272,977

[45] Jun. 16, 1981

[54] METHOD AND APPARATUS FOR NECKING-IN AND FLANGING A CONTAINER BODY

[76] Inventor: Laszlo A. Gombas, Rte. 7, Box 555Q, Evergreen, Colo. 80439

[21] Appl. No.: 46,231

[22] Filed: Jun. 7, 1979

[51] Int. Cl.[3] ..... B21D 41/04

[52] U.S. Cl. ..... 72/121; 72/94; 113/120 AA

[58] Field of Search ..... 72/84, 94, 110, 121, 72/124; 113/120 M, 120 W, 120 AA

[56] References Cited

U.S. PATENT DOCUMENTS

| | | | |
|---|---|---|---|
| 3,765,351 | 10/1973 | Kubacki et al. | 113/120 AA |
| 3,782,314 | 1/1974 | Franek et al. | 113/120 AA |
| 4,070,888 | 1/1978 | Gombas | 113/120 AA |

*Primary Examiner*—Lowell A. Larson
*Attorney, Agent, or Firm*—Kyle W. Rost

[57] ABSTRACT

A container body is simultaneously necked-in and flanged at the marginal edge adjacent to an open end by a tool assembly having first and second freewheeling rollers supporting the inside of the body while a die ring moves eccentrically between the rollers. An encapsulating annular nest ring circumferentially surrounds the open end of the body on the second roller to provide metal control, and the first roller innermost in the body is tapered at its end adjacent the second roller to define, in cooperation with a circumferential container body holder ring on the outside body surface, a volume for receiving metal reverse-flowing from the necked-in portion to prevent the metal from bulging. Compressive forming forces are minimized by the use of springs biasing the two rollers together that are characterized by spring force that increases with increased spring compression at less than a linear rate. Near the conclusion of the necking and flanging process, the neck is subjected to pure tensile forces to draw excess metal from the volume holding reverse-flow metal. A rotary action machine employing the tool assembly employs a spindle for converting linear motion into rotational motion to control the tool assembly operation through relative rotation of eccentrics within the tool assembly. A drag brake prevents rotation of the rollers or die ring with respect to the container body to prevent scratching of protective coatings, while permitting surface-to-surface rolling without slippage between the body and tool assembly components in contact with it.

57 Claims, 16 Drawing Figures

METHOD AND APPARATUS FOR NECKING-IN AND FLANGING A CONTAINER BODY

BACKGROUND OF THE INVENTION

1. Field of the Invention

The invention relates to metal deforming and specifically to the formation of a necked and flanged metal container body. Apparatus for simultaneously necking and flanging an open end of a container body employs a die ring on the outer surface of the body interacting with a pair of separable rollers on the inside of the body.

2. Description of the Prior Art

In the art of manufacturing cylindrical metal containers, especially beverage cans, the open end or ends of a can body are flanged radially outwardly in preparation for placing a disc-like plate over the open end and seaming the plate to the flange to form a closed can. The most direct way of forming the flange is to apply a flanging die to the open end of the can body, resulting in a flange extending radially beyond the outer diameter of the cylindrical body. After application of the end plate and seaming of the end plate to the flange, the resulting seam or can chime remains radially extending outside the outer diameter of the finished can body. The radially extending chime is undesirable for at least two reasons: first, when the cans are packaged, the chimes abut and result in a substantial gap between the cylindrical walls of adjacent cans; and second, the metal disc placed over the open end must be larger in diameter than the diameter of the flanged can end opening, resulting in greater material costs than would be required if the flange were of smaller diameter.

The process of necking-in the open end of the can body provides a remedy to both of the stated disadvantages of the radially protruding chime. Such necking is commonly practiced by applying the open end of the body to a necking die, after which the necked body is applied to a flanging die, with the result being a can body that is both necked-in and flanged. This beverage can configuration is well-known and may be observed in many commercially available beverage containers. The need for the present machine arises from an economic desire to manufacture necked-in and flanged containers in a single step rather than in two steps, and correspondingly to employ only a single machine for the process instead of two machines. Furthermore, the presently employed processes for necking and flanging apply a column load to the cylindrical container body, thereby introducing a limiting factor in the minumum column strength required in the container body. If the column strength requirement could be reduced, the container wall could be made thinner with a resultant savings in material costs.

Most beverage cans are manufactured from either aluminum or steel. The well-known three-piece can is formed from a cylindrical body with independent top and bottom end closure plates, while the newer two-piece can is formed from a cup-like can body having an integral bottom end and an independent top end plate. The side wall of the two-piece body is of controlled thickness to minimize material content in accordance with functional requirements. For example, near the axial center of the cylindrical side wall, the metal is a minimum thickness, while the marginal edge of the side wall adjacent to the open end is relatively thicker to accommodate the flanging and seaming operations to which this area of the side wall will be subjected. This top edge of the side wall in aluminum cans is commonly between 0.009 and 0.006 inches, while in steel cans the thickness may be slightly greater, such as 0.012 inches. Thus, although the side wall thickness may vary at different axial locations in the can body, the thickness is predetermined within a close range at any one axial portion, and it is therefore possible to design can-handling equipment that anticipates can bodies formed with relative precision. Correspondingly, changes such as a decrease in column load requirements of a can body can be translated into realistic material savings through decrease in wall thickness in selected axial portions of the can body.

A number of machines have been proposed to perform combined necking and flanging operations, usually by a roll forming method that would have the advantage of substantially eliminating column load during these forming operations. No commercially practical apparatus is yet known for this purpose, since a number of factors other than the naked forming of the neck and flange must be considered in order to produce consistently acceptable containers. One such factor is that metal container bodies are coated on the interior surface with an inert material to prevent the beverage or other contents from acquiring flavor tones from the metal. Equally as important for commercial production is that the exterior surface is decorated or labelled, usually by a printing process applied to substantially the entire exterior cylindrical surface of the container. The interior and exterior coatings are applied prior to necking and flanging because of the ease in handling, printing, and coating the almost perfectly cylindrical side wall as compared to a side wall with a neck or flange at the open end thereof. Consequently, the necking and flanging apparatus must take account of these coatings and be relatively non-destructive to them, which is difficult to accomplish while forming the metal with the relative precision required for a consistent neck and flange configuration. A high friction spinning tool applied to the coatings creates a danger of scratching, and if forming forces are sufficiently great, the metal itself may flow and substantially disrupt the integrity of the coatings.

Other problems that commonly result from prior attempts at combined necking and flanging are that the flange may become overly brittle or crack, and neck formation may produce a reverse flow of metal, axially toward the base or opposite end of the can body, resulting in a bulge radially outward from the cylindrical side wall surface. The neck and flange are formed at the immediate edge of the side wall adjacent to the open end thereof, and the flange is therefore relatively uncontained by any portion of the side wall at the end opposite from the neck, with the result that the flange is inadequately controlled during formation of the neck and tends to wrinkle. Any of these problems lead to unacceptable containers. The causes may be the subject of speculation, but it is believed that the major causes are over-working of the metal, excessive compression of the metal with resultant metal fatigue, and inadequate metal control.

SUMMARY OF THE INVENTION

An apparatus and method for forming a radially outwardly extending flange in the marginal edge of a metal cylindrical container body while at the sme time forming a necked-in annular feature of smaller circumference than the remainder of the cylindrical container body and immediately adjacent to the flange employ a pair of axially separable support members that are received inside a container body having an open end. The marginal portion of the body at the open end is received between the inner circumference of an encapsulating annular shoulder or lip of a nest ring and the outer circumference of the second, axially outermost support member, relative to the interior of the container body, to provide metal control during formation of the marginal portion into a flange during subsequent forming operations. A portion of the container body axially spaced from the marginal portion and circumferentially overlying the first support member is itself annularly surrounded by a holder ring having very little or no clearance with the outer circumference of the container body. Axially between the holder ring and nest ring is a freewheeling annular die ring circumferentially surrounding the container wall. During the necking-in and flanging operation, the die ring moves radially toward one point of contact with the container wall while the first support member, which is a freewheeling roller of substantially smaller diameter than the inner diameter of the container, supports the container wall in tangential axial alignment with the die ring contact point, while the second support member, which is a roller of approximately the same diameter as the container, supports the marginal edge of the container while approximately axially aligned with the container axis. The die ring and first support roller orbit the axis of the second support roller with the first roller rolling in surface-to-surface contact with the inside of the container, and when the die ring contacts the exterior of the container, it likewise rolls in surface-to-surface contact with the container.

As the die ring becomes increasingly eccentric with respect to the second roller axis, the container wall is deformed into a necked-in feature and the first and second roller are axially separated by the interposed portion of the die ring. The marginal edge of the container wall reacts to the initial necking and compressive stresses between the die ring and rollers with radial expansion because of biaxial stress and is controlled by the limiting, encapsulating presence of the nest ring from expanding radially beyond the available clearance with the nest ring, which may be between fifty percent and one hundred percent of the container wall thickness at the marginal edge. Some of the container metal from the initially necked-in portion reverse flows away from the open end and attempts to radially bulge the container wall, but this is controlled by the holder ring and by a taper in the orbiting first roller creating a volume to receive this reverse flowing metal in a controlled manner.

As the die ring becomes still more eccentric with respect to the second roller axis, the necked-in feature becomes more deeply defined and the marginal edge is drawn off the second roller and radially inward into a radial position between the second roller and a radial face of the die ring, with the nest ring having sufficient axial length to contain the marginal edge against radially outward spreading until such time as the marginal edge is drawn inward from the nest ring. The excess metal formerly received between the holder ring and first roller is reshaped under pure tensile stress as the die ring moves past the radial face of the first roller with minimal compressive stress on the metal container wall, now pulling the wall over the slight taper in the first roller to eliminate bulge.

The apparatus for performing the necking flanging function is a machine having a main shaft mounted for rotation on a base frame and carrying for rotation a central star wheel with container holding pockets on the circumferential edge thereof. A cam actuates rams that in turn operate push plate assemblies to move container bodies from the star wheel pockets into tool assemblies axially aligned with the push plate assemblies. Another cam actuates rams that are connected to spindle assemblies for translating the linear motion of the rams into purely rotational motion. The rams, push plate assemblies, spindle assemblies and tool assemblies orbit the main shaft. Each spindle assembly supports a tool assembly as noted above. The spindle assemblies and tool assemblies are rotated on their own axis, as by a pinion gear on each spindle assembly engaging a bull gear connected to the machine frame, so that the pinion gear is rotated as it orbits the bull gear and in turn rotates the spindle assembly and tool assembly. Within each spindle assembly, the linear motion of the ram is translated into rotational motion by a ball nut and actuator screw. A portion of the tool assembly is connected to the spindle assembly for mandatory synchronized rotation, while another portion of the tool assembly is connected to the spindle assembly for relative rotation in response to the translated linear to rotational motion.

The tool assembly has a central mandrel having a defined axis of rotation, and the mandrel is connected to the spindle for synchronized rotation. Axially within the mandrel is an actuator rod connected to the spindle to receive the relative linear-to-rotational motion. The actuator rod transmits the relative rotation to an eccentric bushing riding on an eccentric portion of a pilot bushing, with the first or orbiting roller carried on the eccentric bushing for both freewheeling rotation and axial sliding displacement. The second or pilot roller is carried adjacent to the first roller and is freewheeling on a concentric portion of the pilot bushing. The pilot bushing is connected to be rotated by the eccentric bushing after a 180 degree lag during which, at the initiation of a necking and flanging operation, the high point of the eccentric bushing is rotated into radial alignment with the high point of the eccentric portion of the pilot bushing to move the orbiting roller from a concentric position relative to the mandrel axis to an eccentric position tangent to a common plane with the pilot roller. The pilot bushing is connected to an eccentric hub that is rotatably carried on an eccentric mandrel such that the high point of the pilot bushing eccentric is 180 degrees from the high point of the eccentric hub. Rotation of the pilot bushing after the 180 degree lag initiates rotation of the eccentric bushing to bring the high point thereof into radial alignment with the high point of the mandrel eccentric portion after a further 180 degree rotation. The eccentric hub carries a tool housing to which is mounted the ring die. When the eccentric hub and mandrel eccentric portions have the high points of their eccentrics aligned, the ring die is eccentric in the opposite direction from the orbiting roller, bringing a portion of the ring die between the orbiting roller and pilot roller to force the rollers in axially opposite directions.

Resilient spring means bias the rollers toward each other, and annular dish springs arranged alternatingly concave and convex, with radial grooves extending partially from the outer circumference toward the inner circumference, soften the spring force, as compared to the typical linear spring force of a helical compression spring near the end of the necking and flanging process when the orbiting and pilot rollers are nearing maximum separation.

The nest ring is connected to the pilot roller and provides a radial abutment wall to limit entry of the container body into the tool assembly and over the pilot roller. In the push plate assembly, resilient means bias a container push plate toward the tool assembly, and the push plate resilient means is yieldable at a lower force than the springs axially biasing the pilot roller so that each container body will enter the tool assembly to the same distance for creation of a uniform flange, while the push plate resilient means yields and permits any excess container length to be received in a recess in the push plate assembly.

To prevent initial rotation of the freewheeling ring die, pilot roller and orbiting roller with the mandrel because of bearing friction, a drag brake is applied to the tool assembly housing, the ring die is in frictional contact with the nest ring, and the orbiting roller abuts the pilot roller. After the orbiting roller and pilot roller have contacted the container body, the frictional contact prevents random rotation. The drag brake continues to be applied to the ring die during necking and flanging by means of a torsionally biased eccentric pin carrying the brake to follow to orbiting motion of the ring die and the tool assembly housing.

The principle object of the invention is to create apparatus for necking-in and flanging a cylindrical metal container wall near the open end thereof in a commercially acceptable manner. The container is thus handled in a manner to protect the integrity of the external decoration and internal coating. In addition, the necking and flanging operations are carried out under controlled metal forming conditions wherein compressive stress is minimized.

A further object is to create an apparatus for performing the desired necking and flanging operations at relatively high speeds, such as at speeds as high as 1200 cans per minute. A machine having twenty-four tool assemblies is anticipated to operate at such high, commercially desirable speeds. Each tool assembly is capable of rapidly and dependably receiving and discharging the container bodies by virtue of its concentric configuration during insertion and removal of the bodies. In addition, the container bodies may remain relatively stationary in the star wheel pockets during the necking and flanging operation.

DESCRIPTION OF THE PREFERRED EMBODIENT

Figure 1:
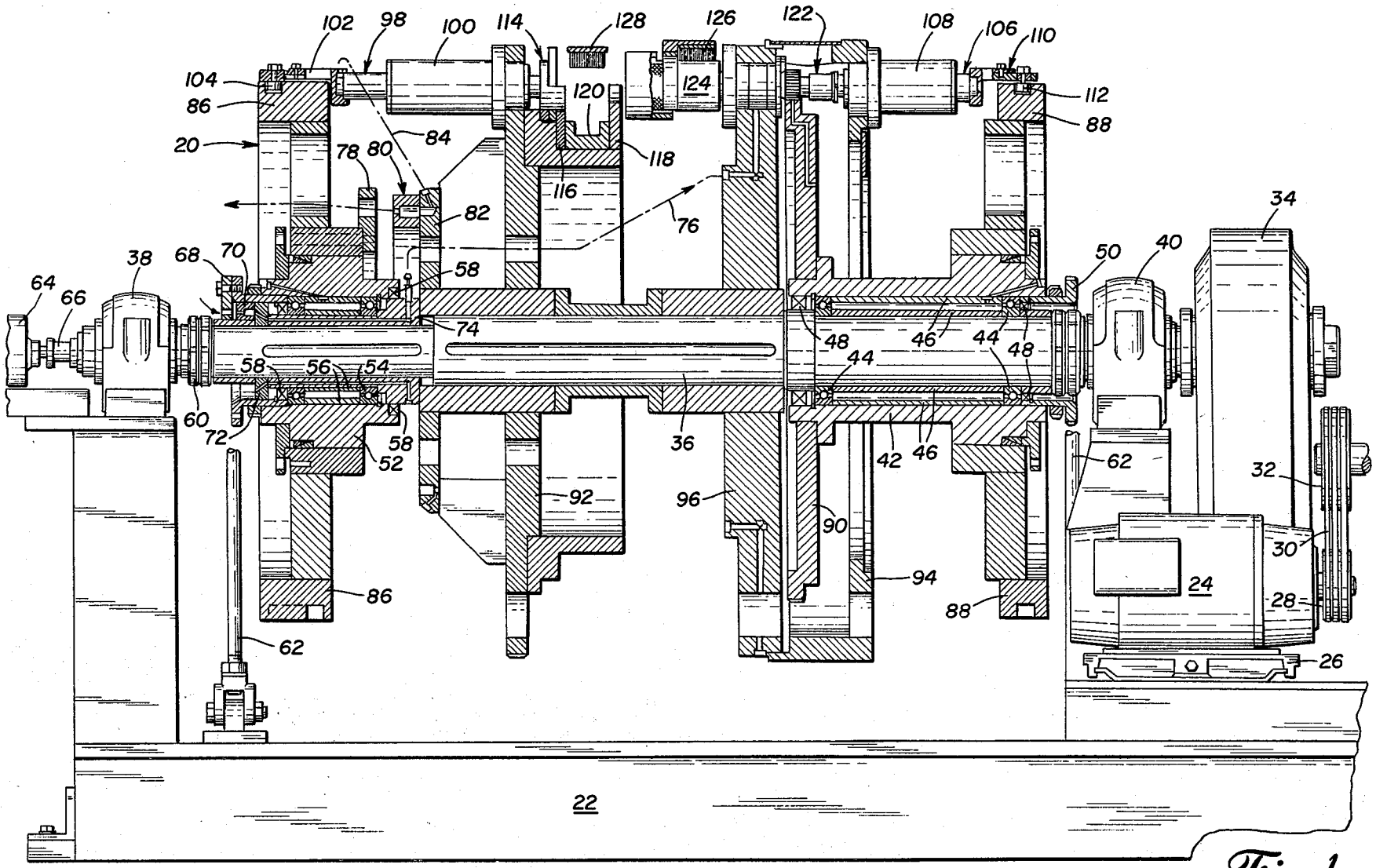
FIG. 1 is a side elevational view of the necking-flanging machine in partial section.

The overall roll-necker-flanger machine 20 is best shown in FIG. 1 in an embodiment having twenty-four tool stations. The type of container body for which the machine is best adapted is the drawn and ironed metal container body having a cylindrical side wall closed at a first or lower end by an integral domed bottom wall and open at the opposite or upper end to permit the container to be filled, after which the upper end is closed by seaming a metal disc over the open end. Through the use of a necked-in cylindrical body adjacent to the upper end, the disc may be of smaller size and thereby contain less metal, and the seam or bead between the disc and the body will not necessarily protrude radially beyond the sides of the body, thereby permitting the containers to be packaged with a minimum of space between adjacent containers. The free upper edge of the body defining the open upper end is flanged radially outwardly in anticipation of the seaming process with the metal end disc. Container bodies are presently formed from a variety of metal alloys of both steel and aluminum.

For purposes of description, the machine 20 may be described as having a "dome side" and "tool side", referring to the axial ends of the machine relative to the domed bottom or open tool receiving top, respectively, of a container body being processed in the machine.

The machine employs a base 22 supporting a motor 24 on a slidable base 26. The motor drives a pulley 28 carrying a plurality of V-belts 30 engaging pulley 32 connected to speed reducer 34, which in turn drives main shaft 36 carried on the base by pillow blocks 38 and 40. At the right hand end of the main shaft, as viewed in FIG. 1, a tool side trunnion hub 42 is carried on the main shaft supported by radial bearings 44 that are separated by bearing spacers 46. Suitable oil seals 48 are provided at the opposite ends of the trunnion hub. A thrust nut 50 holds the trunnion hub in place against a raised portion of the main shaft upon which the left hand oil seal is mounted. At the left hand end of the main shaft as viewed in FIG. 1 is supported another trunnion hub referred to as the dome side trunion hub 52 carried on bearings 54 spaced by spacers 56 and having oil seals 58 outside the bearings 54. The dome side trunnion is held in place on the main shaft by a lock nut 60. The main shaft is capable of relative rotation with respect to the two trunnion hubs by virtue of the bearings between the hubs and shaft. A tie rod 62 connects each hub to the base to prevent the hubs from rotating with the shaft. The rods are adjustable in length at their ends to permit the hub and cam positions to be accurately adjusted. An encoder 64 is joined to the main shaft by coupling 66.

Means for supplying vacuum and compressed air are associated with the machine, for example at the left hand end of FIG. 1 where compressed air is delivered to the machine from an external supply (not shown) through air manifold bracket 68, fixed adjustably to the dome side trunnion hub to air manifold 70, which is in contact with wear plate 72. The bearings 54 for the dome side trunnion hub ride on bearing holder liner 74, which rotates with the main shaft and is keyed thereto. The wear plate is attached to rotate with liner 74, and suitable air passageways extend through the wear plate and liner to transmit compressed air to the inner end of the dome side trunnion hub, where the air may be carried by suitable conduit means 76 through further machine parts that are rotating with the main shaft. Vacuum is supplied from an external source (not shown) through vacuum manifold bracket 78 fixed adjustably to the dome side trunnion hub. The vacuum is supplied to the vacuum manifold 80, adjustably connected to the bracket 78 for a proper fit against vacuum manifold wear plate 82, which is connected for rotation with the main shaft. Suitable vacuum conduit means 84 then connects the needed vacuum to other machine parts rotating with the main shaft.

Other machine components fixed to the trunnion hubs include the dome side cam 86, the tool side cam 88, and bull gear 90. Between the two trunnion hubs, the rotating components of the machine include the dome side ram turret 92, the tool side ram turret 94, and spindle housing 96. The dome side ram turret supports a plurality of dome side rams 98, each supported in a cam cartridge 100 and having an associated cam follower holder 102 and cam follower 104 operating in the dome side cam. The tool side ram turret similarly supports a plurality of rams 106, supported in a ram cartridge 108 and having a cam follower holder 110 and a cam follower 112 operating in the tool side cam. The dome side ram turret also carries a plurality of can push plate assemblies 114, one in association with each dome side ram, and the turret 92 also supports a two part star wheel assembly having a dome side wheel 116 and a tool side wheel 118 separated by star wheel spacer 120. The spindle housing 96 supports a plurality of spindle assemblies 122, each associated with a tool side ram 106 and connected to a tool assembly 124. A tool drag brake assembly 126 may be associated with each tool assembly 124 for restricting the rotation of the tool assembly with respect to the drag brake, and an inlet track assembly 128 is attached to the machine between the can push plate assemblies and the tool assemblies for delivering cans to the star wheel assembly.

Figure 2:
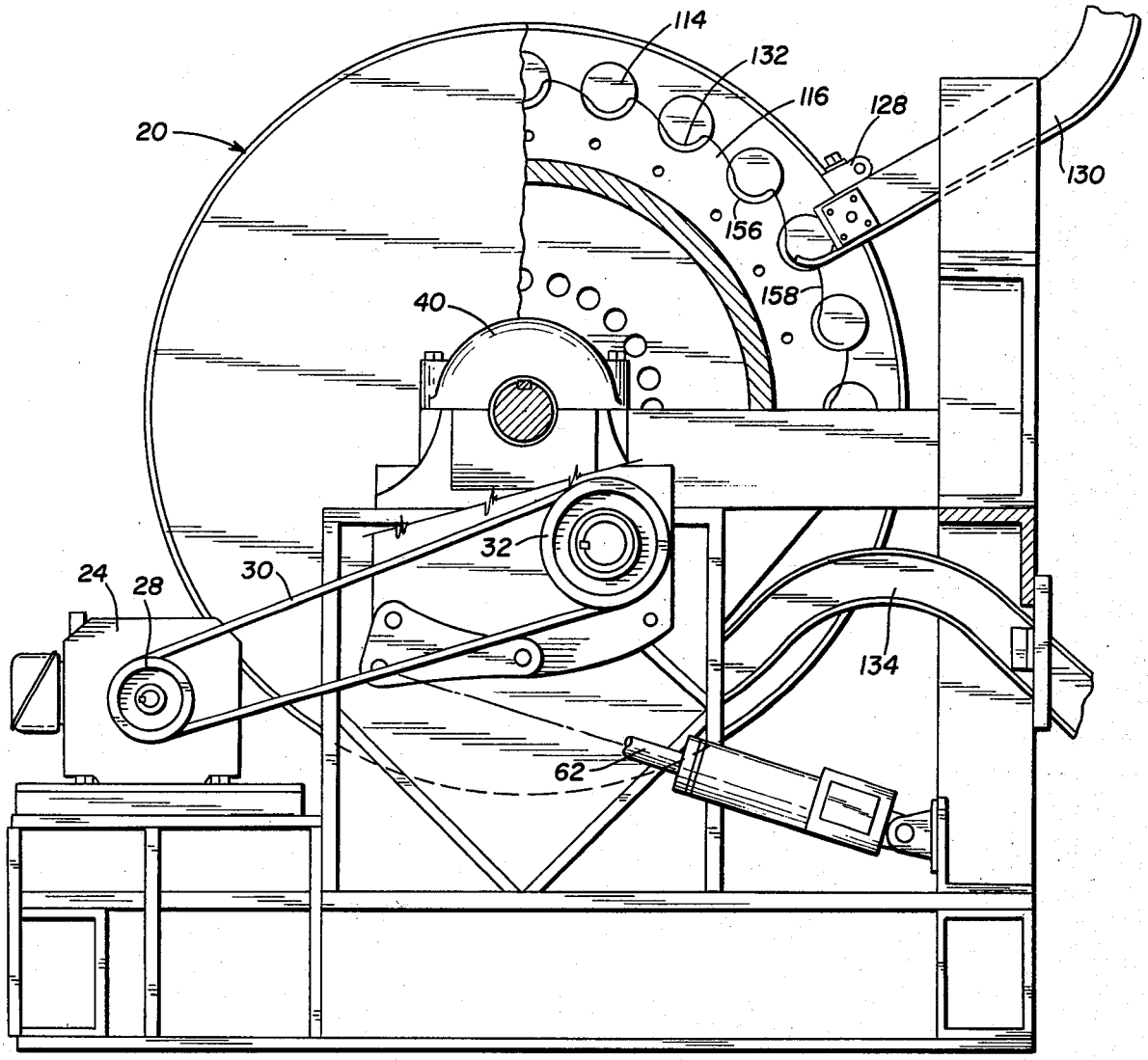
FIG. 2 is an end elevational view of the necking-flanging machine in partial section.
Figure 3:
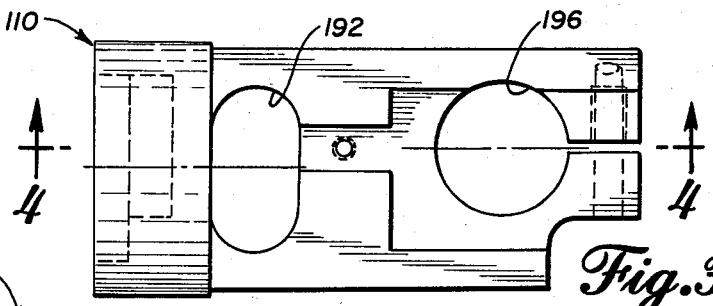
FIG. 3 is an enlarged top view of a cam follower holder.
Figure 4:
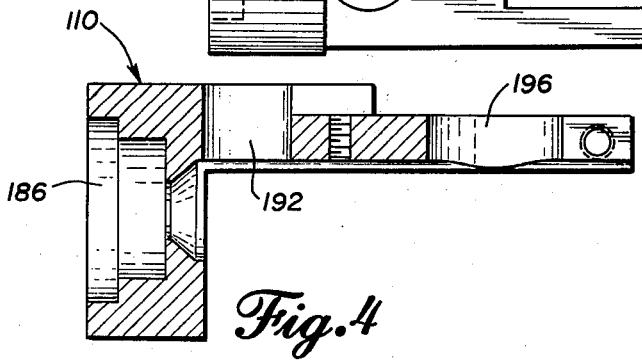
FIG. 4 is a sectional view taken on the plane of line 4—4 of FIG. 3.
Figure 5:
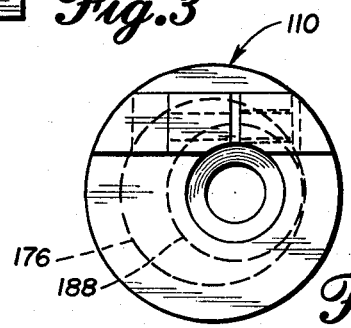
FIG. 5 is an end view of the cam follower holder of FIG. 4 taken from the right-hand end thereof.

In the drive end view of the machine 20 of FIG. 2, the machine will be seen to be of the rotary type having a can inlet track 130 delivering containers having at least one open end for the necking and flanging process. Each container is delivered to one pocket 132 of the star wheel assembly as the wheel rotates in counterclockwise direction in FIG. 2 through an arc of approximately 270 degrees, whereupon the container encounters the unloading track assembly 134 that removes the container from the rotating wheel and directs the container to an external point. Between the inlet track and the unloading track, the container is subjected to a combined necking and flanging operation directed by the contours of the dome and tool side cams. The primary function of the dome side of the machine is to move containers deposited in a pocket of the star wheel assembly into the tool assembly, where the necking and flanging take place; and following the necking and flanging operation, to withdraw the container from the tool assembly onto the star wheel so that the container may be discharged from the machine at the unloading track. The primary function of the tool side is to operate the tool assembly in coordination with the operation of the dome side so that a container will be necked and flanged during the time when it is properly positioned with respect to the tool assembly.

Figure 6:
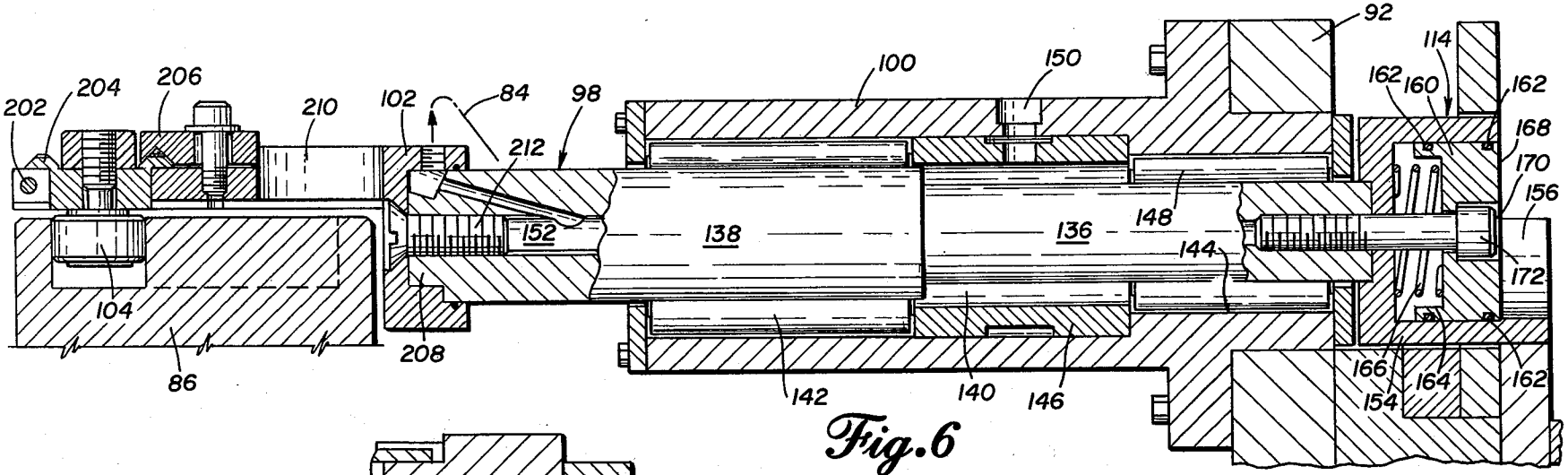
FIG. 6 is a cross-sectional view of a dome side ram assembly showing the dome side can and push plate assembly.
Figure 7:
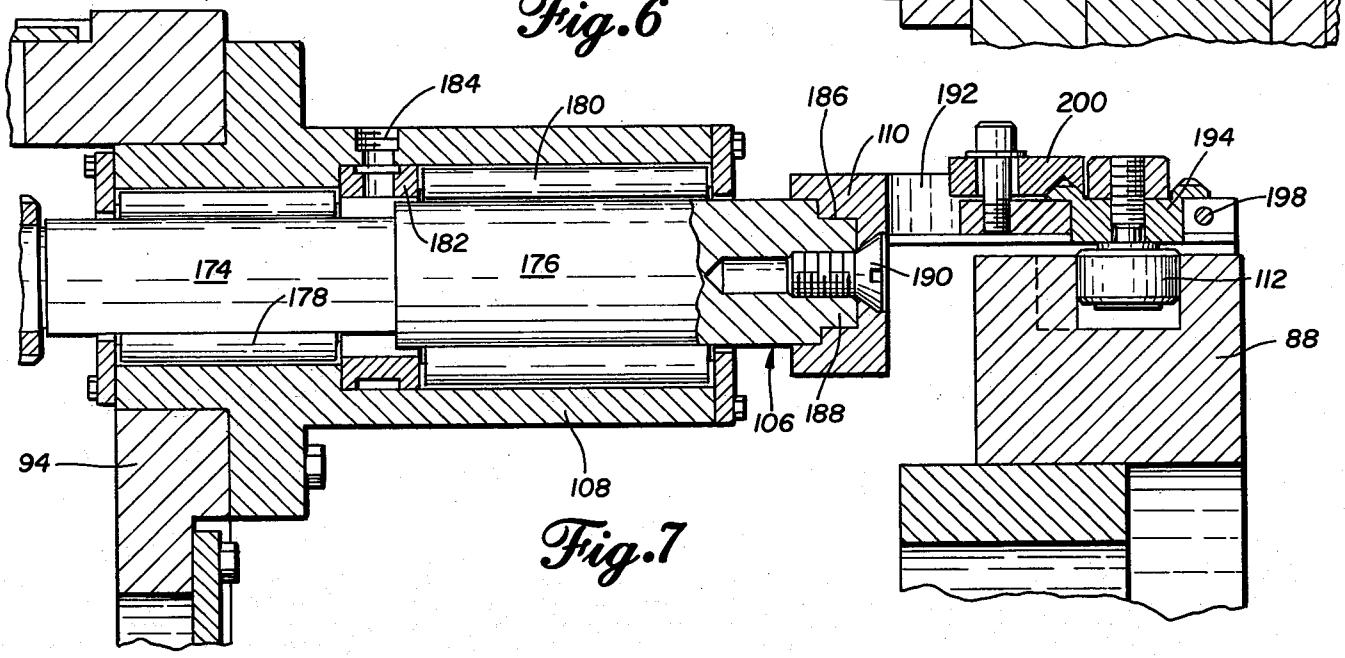
FIG. 7 is a cross-sectional view of the tool side ram assembly, showing the tool side cam.

FIGS. 6 and 7 illustrate the components of the ram assemblies on the dome and tool sides of the machine. In FIG. 6, the dome side ram assembly includes the ram cartridge 100, ram 98, cam follower holder 102 and cam follower 104 as previously identified. The cam 86 is preferably a barrel cam having a two sided groove providing positive movement of the follower 104 during either forward or rearward motion, which is transmitted to the ram 98 to produce linear motion in the can push plate assembly. The ram cartridge 100 provides a mounting for the ram 98 with respect to the ram turret 92. The ram itself is of dual diameter with a relatively narrow forward cylindrical portion 136 having a defined first longitudinal axis, and a relatively wider rearward cylindrical portion 138 having a different second longitudinal axis parallel to and offset from the first axis, with the result that the rear portion is eccentric with respect to the front portion. The cartridge 100 has similarly offset bores to accommodate the two portions of the ram in a single rotational position, with the rear bore 140 supporting the rear portion 138 on linear bearings 142, spaced from the front bore 144 by bearing spacer 146. Linear bearings 148 support the narrow portion of the ram in the front bore. The ram is capable of linear longitudinal motion with respect to the cartridge, but the eccentric relationship between the axis of the two ram portions prevents rotational motion with respect to the cartridge. Access opening 150 allows lubrication of both linear bearings 142 and 148. A central bore 152 through the ram on the first longitudinal axis provides a passageway for vacuum from line 84. The rear end of the ram is attached to the cam follower holder 102, and the front end is attached to the can push plate assembly.

The push plate assembly 114 includes a can nest 154 that serves as a keeper for the remaining parts of the assembly and provides a portion of the dome side star wheel configuration. The can nest is generally cup shaped except at the forwardly protruding lip 156 along the lower edge, as viewed in FIG. 6. This lip on the radially inner edge of the nest with respect to turret 92 forms the bottom of the can pocket in the dome side star wheel, as best shown in FIG. 2, and intermediate ramp portions 158 of the dome side star wheel interconnect the lips 156 to complete the desired star wheel contours. Inside the cuplike contour of the can nest is carried a push plate 160 by frictional mounting such as rubber O-rings 162 to seal off vacuum when retracting cans. The push plate has a recess defined by an annular rearwardly extending wall 164 to locate a coil spring 166 between the push plate and end wall of the can nest. The forward face 168 of the push plate contains a recess 170 in alignment with a bore to receive retaining screw 172, which engages a thread in the forward end of the ram bore 152. The screw 172 contains an axial bore connecting the vacuum in ram bore 152 to the forward face of the push plate, where the vacuum may be applied between the push plate and the bottom of a can body contacting the push plate. From the structure described, the operation of the dome side ram is to push the push plate assembly forward, or away from the cam to engage the push plate against the bottom of a container resting on the star wheel assembly and push the container into the tool assembly. The push plate is supported on the resilient spring 166 and may therefore retreat into the can nest when the can is pressed forward with a predetermined force. Vacuum may be applied through the ram and retaining screw to hold the container against the push plate by suction when the ram and push plate assembly are retracted to withdraw the container from the tool assembly. The inner diameter of the can nest is slightly larger than the outer diameter of the container size with which the machine is intended to operate so that the container may enter the can nest. A pressure switch between the rear side of the push plate and the base of the can nest may be used to detect a damaged container, such as a container that is unable to properly enter the tool assembly and therefore must retreat overly far into the can nest.

On the tool side of the machine, the tool side ram assembly includes the ram 106 having a dual eccentric configuration much like the dome side ram, wherein a relatively narrow cylindrical ram portion 174 has its longitudinal axis offset and parallel to the axis of a relatively wider cylindrical ram portion 176. The ram cartridge 108 is configured with a dual inner diameter supporting the ram portion 174 in linear bearings 178 and supporting the ram portion 176 in linear bearings 180. Bearing spacer 182 and cartridge 108 contain lubrication port 184. The tool side cam 88 guides the cam follower 112, which is connected to the ram 106 through the cam follower holder 110, which is similar in design to the holder 102 and permits fine adjustment of the ram.

The cam follower holder for the tool side of the ram assembly is best shown in FIG. 3–7 to have a ram end engaging recess 186 with two offset cylindrical bores creating a receptacle for a double eccentric portion of the ram. On the cam follower holder end of ram 106 is a cylindrical tip 188 having its axis offset from the axis of the adjacent ram portion 176 to create a double eccentric configuration similar to that engaged in the cartridge 108. The ram end is thus engaged in the holder 110 in a manner that prevents any relative rotation between the holder and ram to resist rotating torque from acting upon cam follower 112. A fastener such as screw 190 holds the ram in the recess 186 and prevents linear displacement between the ram and holder. An access port 192 provides entry for a tool to adjust the screw 190. The cam follower 112 is carried in an eccentric bushing 194 held within split opening 196 in the holder. The eccentric bushing permits the follower to be finely adjusted, and a fastener 198 closes the split opening into clamped engagement with the bushing. A fastening tongue 200 overlies the tapered top edge of the eccentric bushing to provide clamping force to hold the bushing in its selected rotational position in opening 196. The tapered top edge of the bushing and the tongue 200 may have high friction surfaces such as carbide-flame spray, knurling, or the like to prevent slippage between the tongue and bushing. The dome side cam follower holder of FIG. 6 permits similar adjustment of the cam follower and provides the same double clamping arrangement to hold the follower in the selected position with respect to the holder by means of a fastener 202 for clamping the eccentric bushing 204 in the holder, and a tongue 206 pressing against the top of the bushing. The end of ram 98 nearest the cam has an eccentric tip 208 for preventing rotation of the ram with respect to the holder 102. Tool access opening 210 permits adjustment of the fastener 212 attaching the ram to the holder to prevent relative linear motion.

Figure 8:
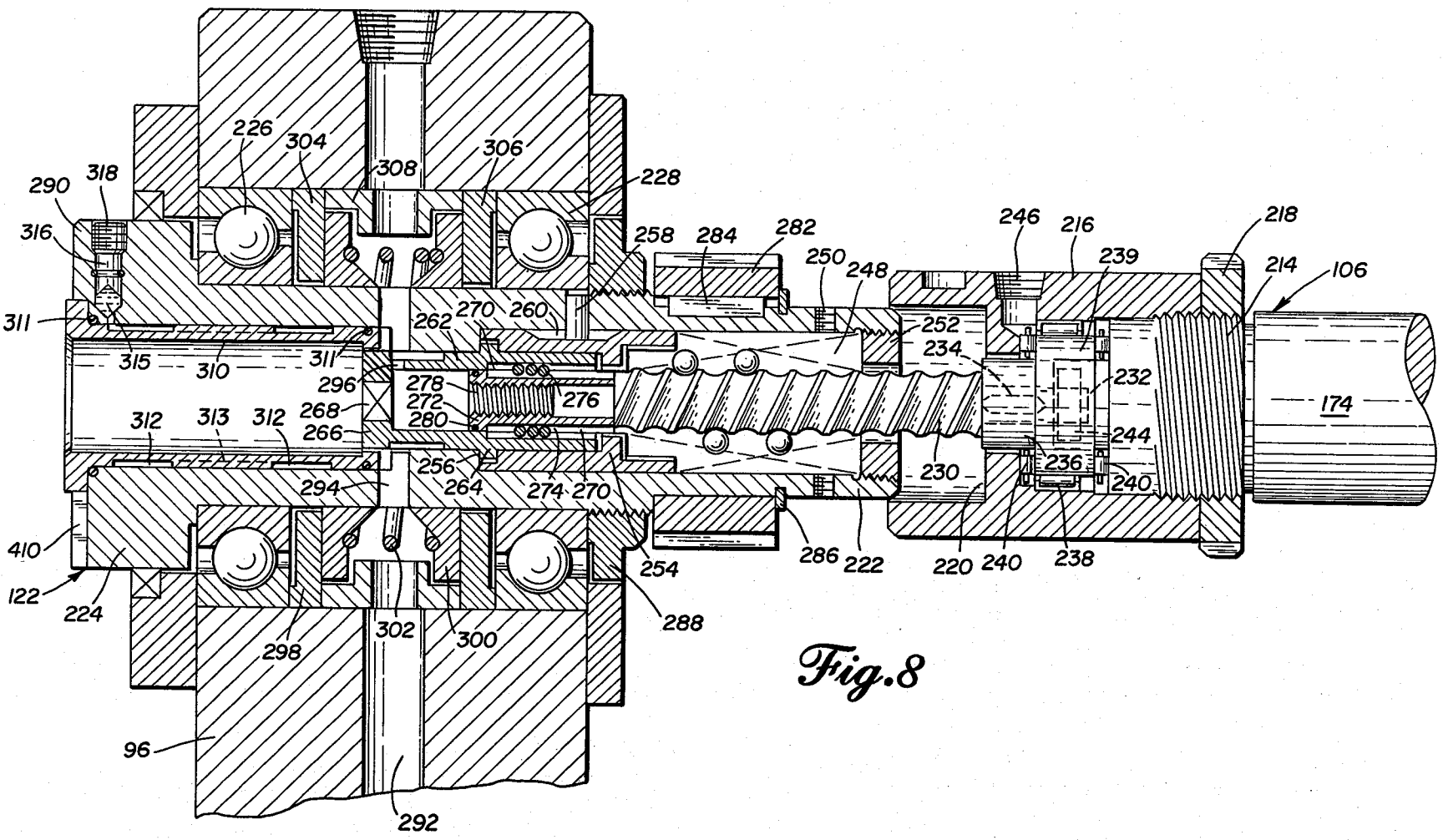
FIG. 8 is a cross-sectional view of a spindle assembly.

Cams 86 and 88 are annular and their grooves provide motion to the followers 104 and 112 parallel to the longitudinal axis of the machine 20. The rams 98 and 106 faithfully transmit the longitudinal motion to operating apparatus attached to the ram ends opposite from their respective cams. On the tool side of the machine, it is necessary to translate the purely linear motion of the tool side ram into purely rotational motion, and for this purpose the spindle assembly 122 is adjustably attached to the operating end of the ram, for example by threads 214 at the end of ram portion 174 engaging the interior of retracting nut 216 and held against rotation by lock nut 218, which is also used to adjust proper thrust-bearing clearances. The retracting nut has a recess 220 formed in the left hand end, as viewed in FIG. 8, adapted to receive the right hand end 222 of the hydraulic spindle 224 therein, providing a shield to protect mechanisms in the spindle 224 from contamination. The hydraulic spindle is carried in the spindle housing 96 for rotation about its own axis by means of radial bearings 226 and 228 between the spindle and housing. Means for translating linear motion into rotational motion are contained in the hydraulic spindle and connected to the retracting nut. Such means include an actuating screw 230 having ball bearing raceways as the threads thereof. At the tool ram end of the screw 230, the screw has a portion 232 of reduced diameter with a key 234 thereon. Thrust hub 236 telescopes over the end 232 and engages the key 234 in a keyway. Needle bearings 238 between the outer circumferential surface of the thrust disc portion 239 of the thrust hub and the inner circumferential surface of the retracting nut permit the hub to rotate with respect to the nut when the actuating screw rotates, and needle thrust bearings 240 between the opposite radial surfaces of the hub and retracting nut permit the hub to rotate when longitudinal pressures are applied between the actuating screw and the retracting nut. A jam nut 244 may be threaded to the screw portion 232 to retain the screw in the thrust hub. The screw 230 is then fixed to the retracting nut for linear motion therewith, although the screw is free to rotate with respect to the nut 216. A lubrication port 246 communicates with the needle bearings associated with hub 236.

In the hydraulic spindle the actuating screw is engaged by ball nut 248 of the known type having recirculating ball bearings that also engage the threads of the actuating screw. The ball nut is retained against rotation in the spindle by a locking device 250 and is retained against longitudinal movement toward the tool side ram by a locking pilot cap 252. Ball nut nest 254 fits between the dome side of the ball nut and shoulder 256 at a point of reduced diameter in the spindle. The ball nut nest is fastened in a fixed position against rotation in the spindle by a dowel pin 258 engaging a longitudinal keyway 260 on the outer circumference of the ball nut nest. A coupler bushing 262 is partially nested in the ball nut nest and has a flange 264 engaged between the spindle shoulder 256 and the ball nut nest, holding the bushing in a fixed longitudinal position. At the dome side end of the bushing, an end wall 266 forms a socket 268 preferably having a square cross-section in the plane normal to the longitudinal axis of the machine. On the inner circumferential surface of the bushing are a pair of opposite longitudinally extending semi-cylindrical bearing races 270. Contained centrally and longitudinally slidably within the coupler bushing is coupler pin 272 having on its outer circumference a pair of opposite longitudinally extending semi-cylindrical bearing races 274, each aligned with a race 270 to form a fully cylindrical race housing balls 276. The coupler pin is joined to the dome side end 278 of the actuating screw, for example by threaded connection. The coupler pin rides on the ball bearings 276 in the races formed between the pin and coupler bushing, and at the dome side end the pin may have a radial flange with an O-ring seal 280 between the pin and bushing. The pin has a longitudinal distance of available linear motion within the bushing, and this distance is approximately the same as the available distance for linear motion between the retracting nut and the spindle in recess 220.

The operation of the spindle assembly 122 as thus far described is that the tool side ram 106 moves longitudinally in response to the tool side cam. The ram causes the retracting nut 216 to be moved longitudinally with the ram, and correspondingly the thrust hub and actuating screw must move longitudinally with the retracting nut. When the ram moves to the left in FIG. 8, the adjusting screw is pushed further into the hydraulic spindle and through the ball nut 248 as the hydraulic spindle enters the recess 220 in the retracting nut. The ball bearings in the ball nut follow the threads of the adjusting screw and cause the screw to rotate with respect to the spindle. The coupler pin rotates with the screw while moving linearly with respect to the coupler bushing, since the coupler pin and coupler bushing are prevented from having relative rotational motion by the balls 276 in the combined races 270 and 274. The coupler pin thus causes the coupler bushing to rotate with the pin, resulting in the square socket 268 having purely rotational motion with respect to the hydraulic spindle. To facilitate the rotation of the coupler bushing against the ball nut nest and hydraulic spindle contact surfaces, the external circumference of the coupler bushing may be coated with a low friction material such as vacuum deposited fluropolymer or carbon-filled fluropolymer. The actuator screw in the preferred embodiment has a one-half inch pitch, producing 360 degree rotation of the screw with one-half inch longitudinal motion in either direction.

The hydraulic spindle is mounted for rotation in the spindle housing and carries a pinion gear 282 keyed to the spindle by key 284 and held in place by retaining ring 286. The pinion gear engages bull gear 90 and drives the hydraulic spindle in constant rotation on bearings 226 and 228 when the main shaft is turning. The bearings are held in place on the spindle exterior between spindle bearing lock nut 288 and spindle flange 290. The supply of compressed air from conduit 76 is fed to the spindle housing via passageway 292 communicating with radial bore 294 through the spindle and radial bore 296 through the coupler bushing into the area between the coupler pin and bushing end wall 266, where the air has access to socket 268. The bearings 226 and 228 are held at a spaced distance on opposite sides of the bore 294 by a pair of wear discs 298 and 300 held apart by compression spring 302. Seal rings 304 and 306 are interposed between the wear discs and bearings and are held in place by seal spacer 308, which has bores in alignment with passageway 292. The seal spacer and seal rings remain stationary with respect to the spindle housing, while the wear discs rotate with the spindle.

The hydraulic portion of the spindle is the engagement means for attaching the spindle to the tool assembly. Cylindrical bushing 310 fits within the dome side of the spindle bore and is tightly sealed at both longitudinal ends by O-ring seals 311. At least two annular grooves 312 are formed on the outer circumference of the bushing 310 and these are joined together by longitudinally extending grooves 313, shown in phantom in FIG. 8. The grooves 312 and 313 are filled with hydraulic fluid, as is port 315 through the spindle flange 290. In port 315 a piston 316 is moved by a set screw 318 to apply pressure to the fluid in the grooves of bushing 310. The bushing walls are sufficiently thin that the fluid will cause them to bulge inwardly at the grooves 312 to engage as inserted shaft at the two locations 312 to hold the inserted shaft in good alignment with the longitudinal axis of the spindle housing. Although in the drawing the port 315 is shown to be radial, better adjustability is achieved when this port is tangential, providing a larger area for fluid in the port due to greater available length.

Figure 9A:
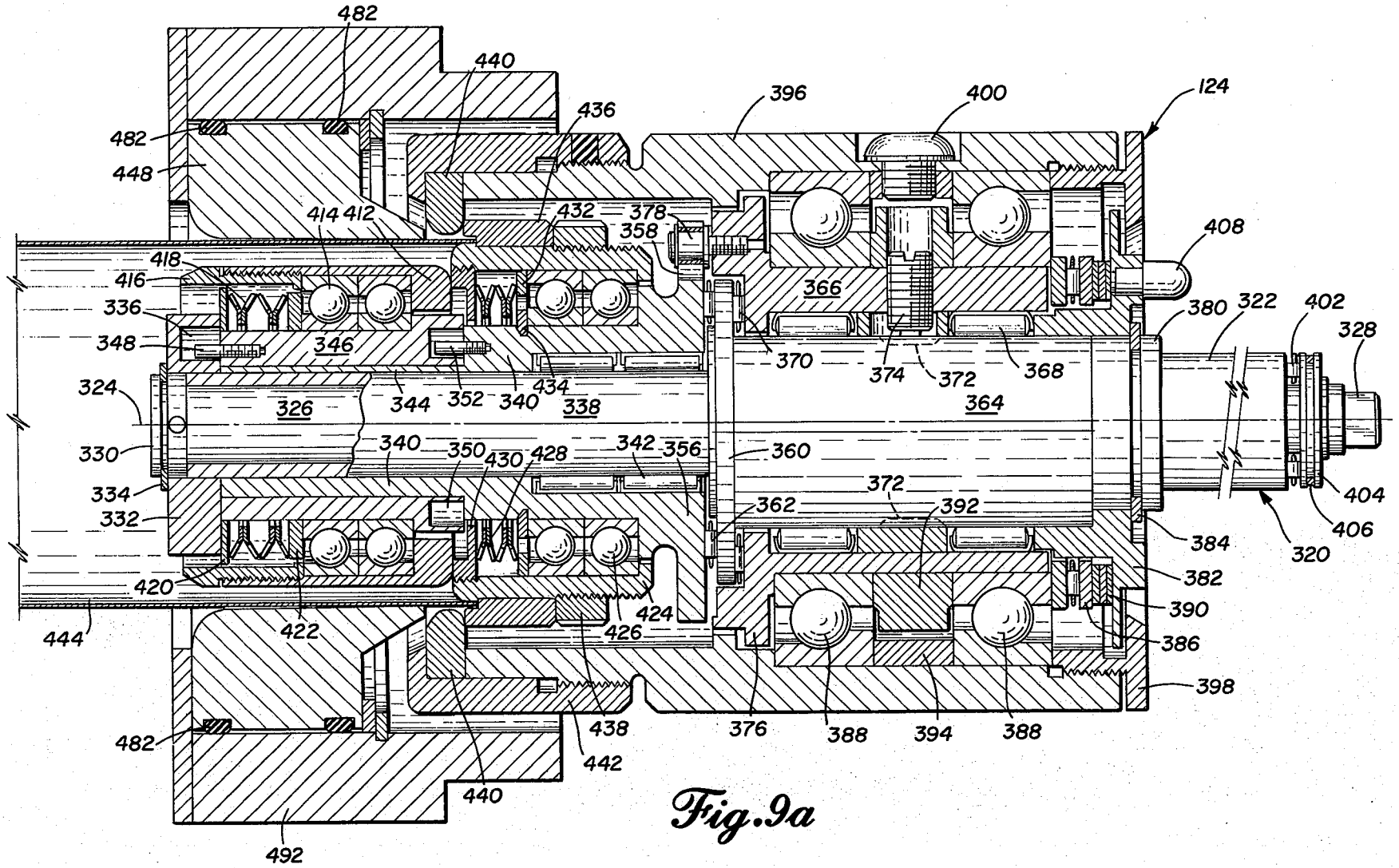
FIG. 9*a* is a cross-sectional view of a tool assembly showing the configuration thereof in concentric or unactuated position.

The tool assembly 124 is engaged in the spindle assembly in the bushing 310. FIG. 9*a* shows the tool mandrel 320 to have a cylindrical rear end portion 322 extending from the tool in the direction of the spindle assembly. Base portion 322 has a longitudinal axis of symmetry 324 defining the main axis of the tool assembly. A bore extends through the entire mandrel along axis 324, and actuator rod 326 is carried in the bore rotatably on the axis. Actuator rod end 328 facing the spindle assembly has a square configuration that mates with the square socket 268 in the coupler bushing, permitting the actuator rod to be turned with respect to the mandrel when the latter component is held in stationary position with respect to the hydraulic spindle by bushing 310. The opposite end of the actuator rod has a radial shoulder 330 extending for substantially the thickness of the mandrel immediately adjacent thereto. Actuator disc 332 overlies a portion of the shoulder and the adjacent portion of the mandrel, and is keyed to the shoulder for mandatory rotation with the actuator rod while riding on the outer surface of the mandrel. The key may be formed by one or more dowel pins sharing axially extending semi-cylindrical grooves on the mating surfaces of the disc and shoulder. A retaining ring 334 holds the dowel pins in the grooves and retains the disc axially on the rod. A radially elongated slot 336 is formed on the inside face of the actuator disc for a purpose discussed below.

The front end or nose 338 of the mandrel extends in the direction of the dome side of the machine and is concentric with the main axis 324 and shoulder 330 to provide a uniform surface supporting the actuator disc 332. This same end 338 carries pilot bushing 340 suitably mounted on needle bearings 342 for rotation on the main axis 324. The pilot bushing is concentric at its rear, to the right in FIGS. 9, but is eccentric at its nose 344, to the left of FIGS. 9. The pilot bushing nose rotatably supports eccentric bushing 346, which has its circumferential center offset from its rotational center by the same distance as the eccentricity of the pilot bushing nose upon which it rides. A first actuator pin 348 extends axially from the left-hand face of the radially thickest part of the eccentric bushing and mates with slot 336 in the actuator disc. The right-hand face of the bushing 346 contains an arcuate slot 350, also shown in FIG. 10, covering an arc of 180 degrees and following the curvature of the bushing bore as contrasted to the curvature of the outer circumference. A second actuator pin 352, thicker than pin 348, is mounted in the shoulder 354 of the pilot bushing, extends into the slot and permits the eccentric bushing to rotate with respect to the pilot bushing only within the limit of pin motion in the slot. Thus, when the mandrel is held stationary with respect to the spindle assembly and the actuator rod is caused to rotate, the rod rotates the actuator disc, which operates through pin 348 to cause the eccentric bushing 346 to rotate. The bushing rotates through an arc of 180 degrees as the slot 350 moves with respect to the pin 352, after which the end of the slot strikes the pin and induces rotation in the pilot bushing. Because the eccentricity of the eccentric bushing is identical to the eccentricity of the pilot bushing nose, the relative position of these two components will result in a net eccentricity on the mandrel nose of between zero and twice the eccentricity of either of the components individually.

At the extreme rear end of the pilot bushing is a radial flange 356, and in the circumference of this flange is cut a radially extending slot 358. Between the mandrel nose 338 and the mandrel base 322 is a radial mandrel flange 360 serving as one side of a bearing race for thrust bearings 362, which also rides on flange 356; and eccentric mandrel portion 364 supports an eccentric hub 366 on suitable bearings 368. Thrust bearings 370 separate the forward end of the eccentric hub from mandrel flange 360. The eccentricity of the mandrel portion 364 and of hub 366 are identical, with the result that the net eccentricity of the two components in various relative positions of rotation may be between zero and twice the eccentricity of either component alone. At the high and low points of mandrel portion 364 are detent seats 372, and at the high point of the eccentric hub, at the axial position to overlie the detent seats, the hub contains a threaded aperture housing a ball detent plunger 374 supporting a detent ball in position to engage the detent seats when in proper rotational alignment therewith. When the ball detent is engaged, the outer circumferential surface of the eccentric hub is therefore either symmetrical to the main axis or unsymmetrical by double the eccentricity of the hub or mandrel. The nose end of the eccentric hub forms a radial flange 376 extending radially beyond the mandrel flange 360 by a sufficient distance to support the third actuator pin 378, which is engaged in the slot 358 in the pilot bushing second flange 356. Whenever the pilot bushing rotates with respect to the mandrel, the rotation is transmitted through actuator pin 378 to cause the eccentric hub to also rotate with respect to the mandrel. Because of the 180 degree arcuate slot 350 in the eccentric bushing 346, the bushing may be rotated by 180 degrees before the pilot bushing and eccentric hub start to rotate.

Between eccentric mandrel portion 364 and base end 322 is another mandrel portion 380 concentric with the main axis 324 and having the same radius as the low side of the mandrel portion 364. Thrust cover 382 engages the mandrel portions 364 and 380 in a non-rotatable fit due to the double eccentrics, and is held in place axially be retaining ring 384. A radial thrust bearing 386 is held between the thrust cover 382 and one inner ring of a pair of bearings 388 on the exterior of the eccentric hub by wave spring washers 390. The bearings 388 are separated by inner and outer spacer rings 392 and 394, respectively. Tool housing 396 is mounted rotatably on the bearings 388, and thrust disc 398 threadedly engages the base end of the housing and creates, in combination with retaining ring 382 a labyrinth seal at the base end of the tool assembly. The housing and outer seal ring contain a port alignable with the ball plunger 374, and this port is closed by a screw 400. Other details of tool construction include a thrust bearing 402 operating on the spindle facing end of the mandrel and on thrust washer 404 with rubber O-ring 406 on its circumferential surface for sealing against the interior of the bushing 310 in the spindle assembly. The actuator rod 326 contains an axial bore for receiving pressurized air from the spindle assembly and conducting the air to the nose end of the rod, at the left of FIG. 9. The O-rings 280 on the coupler pin and 406 on the thrust washer create a seal to prevent the air from escaping from the tool and spindle through other avenues. A drive pin 408 extends axially from the base end of the tool assembly on the face of the thrust cover 382. This pin provides a timing function in that it identifies a predetermined side of the mandrel, such as the side where the low point of the eccentric mandrel portion 364 is located. This pin enters a slot 410 in the face of the hydraulic spindle flange to coordinate the insertion of the tool into the hydraulic spindle with the square end of the actuator rod aligned with the square socket 268. In addition, the pin can provide a driving force to the mandrel in the event that the hydraulic spindle fails, releasing its self-aligning grip on the mandrel end 322. The pin would provide a secondary means of holding the tool assembly in approximate alignment with the spindle until the hydraulic portion thereof can be repaired.

The eccentric bushing 346 at the nose end of the tool supports an orbiting roller 412 for rotation thereon, as on a pair of bearings 414 between the roller and bushing. An orbiting roller nose 416 forms a chamfered or tapered outer end for the orbiting roller. The outer surface of the bushing 346 provides a low friction base for the bearings 414 and may be covered with Teflon or like material. Although the bearings 414 are held in fixed position with respect to the roller 412 by the roller nose, the unit consisting of the roller, roller nose and bearings is slidable axially on the eccentric bushing. However, this unit is biased toward the base end of the tool by spring elements 418 retained between wear washer 420 and labyrinth seal washer 422, both of which may be Teflonized to further reduce sliding friction. The spring elements are required to deliver carefully metered force, and for this purpose dish spring elements are especially appropriate, arranged concave to concave side and convex to convex side. The force of each element is softened by forming a plurality of radial grooves evenly spaced about the annular spring elements. The pilot bushing supports pilot roller 424 on a pair of bearings 426, and the pilot roller is coated with low friction material to permit axial sliding with respect to the bearings. Dish spring elements 428 as previously described bias the pilot roller toward the nose of the tool assembly. The spring elements are retained between an adjusting disc 430, providing an adjustment for spring tension and a labyrinth seal, and a wear washer 432. The bearings are also held in place with respect to the pilot bushing by a retaining ring 434. The outer circumferential surface of the pilot roller carries nest ring 436 held against a flange on the pilot roller by adjusting nut 438. At the nose end of the housing 396, an annular die ring 440 is clamped by holder nut 442, which guides and centers the die ring with respect to the housing.

In operation, the tool assembly is originally in the position of maximum overall symmetry, at what may be referred to as zero degrees of rotation, shown in FIG. *9a*. When in this position, the high point of the mandrel eccentric 364 is 180 degrees opposite from the high point of the eccentric hub 366 so that the housing and die ring are concentric with the main axis 324. The high point of the pilot bushing is on the same side of the mandrel as the high point of eccentric 364, and the high point of the eccentric bushing 346 is 180 degrees opposite so that the orbiting roller is concentric with the main axis 324. Rotation of the actuator rod with respect to the mandrel by one-half turn or 180 degrees brings the tool assembly into the configuration shown in FIG. *9b* and initiates the operation of the tool head. During the first 180 degrees of actuator rod rotation, the eccentric bushing rotates with respect to the pilot bushing until the high point of the eccentric bushing is rotationally aligned with the high point of the pilot bushing, moving the orbiting roller to its maximum offset from concentricity with axis 324 and placing the cylindrical surface of the orbiting roller in a position substantially tangent to a common plane with the cylindrical surface of the pilot roller at the nose end thereof, on the side of the mandrel having the high point of eccentric 364. The continued rotation of the actuator rod now rotates the eccentric bushing and pilot bushing together, since the second actuator pin has now bottomed against the end of arcuate slot 350 and must drive the pilot bushing, which in turn must drive the eccentric hub through the third actuator pin. Thus, a further rotation of 180 degrees in the original direction will orbit the orbiting roller about axis 324 until its cylindrical surface is aligned with a plane approximately tangent to the surface of the pilot roller at the nose thereof and on the side of the mandrel having the low point of eccentric 364. The eccentric hub now has its high point rotationally aligned with the high point of eccentric 364, shifting the housing 396 and its attached die ring 440 to a position of maximum offset from symmetry with axis 324, with the housing and die ring being closest to the side of the mandrel having the low point of eccentric 364. In this position the die ring is in the position of maximum interference with the orbiting roller and pilot roller, as shown in FIG. *9c*.

Reversing the direction of rotation of the actuator rod will, during the first 180 degrees, move the high point of the eccentric bushing to the low point side of the pilot bushing, restoring the concentric condition between the orbiting roller and axis 324. A further rotation of 180 degrees in the reverse direction rotates the eccentric bushing with the pilot bushing and eccentric hub, returning the high point side of the hub to the low point side of the mandrel eccentric 364, in turn restoring the housing and die ring to a concentric condition of maximum separation with the orbiting roller. The detent in the mandrel eccentric 364 at its high and low points will maintain the hub and mandrel in either the maximum offset or maximum concentric positions, which ever may exist, in the absence of positive force causing change.

The above description of operation has been with respect to the stationary mandrel. However, the mandrel is held in the hydraulic spindle, which is in a state of rotation itself due to the interaction of pinion gear 282 on bull gear 94 during rotation of the main shaft 36. Thus, the mandrel is in rotation and causes all other parts of the tool assembly to rotate in synchronization with it, except those parts that are freewheeling. The die ring 440 is freewheeling on bearings 388; the orbiting roller 412 and roller nose 416 are freewheeling on bearings 414; and the pilot roller 424 and nest ring 436 are freewheeling on bearings 426. Thus, these components need not rotate, although the rotation of remaining parts of the tool assembly requires that the die ring and orbiting roller orbit the axis 324 whenever their central axis are offset from axis 324. Accordingly, the interface between the die ring, orbiting roller and pilot roller, when the former two components are noncentric with axis 324, will orbit about the axis.

Figure 11:
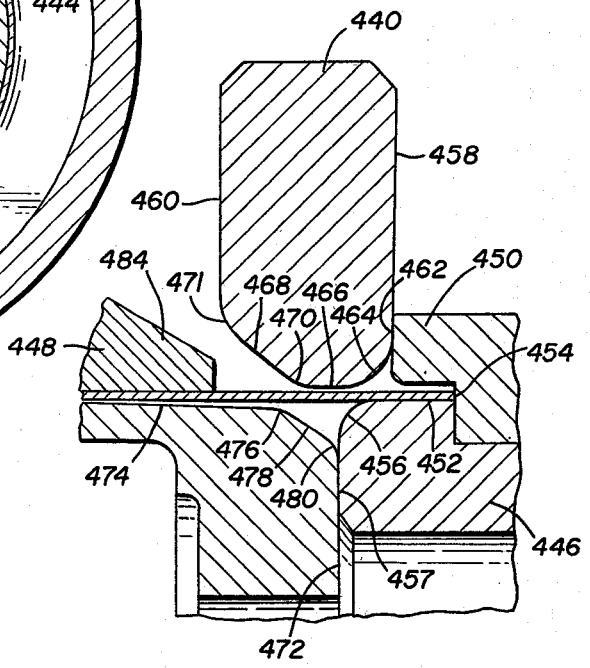
FIG. 11 is an enlarged detailed view of the pilot roller, orbiting roller, die ring, nest ring, and can holder ring in the position of FIG. 9*a*.
Figure 12:
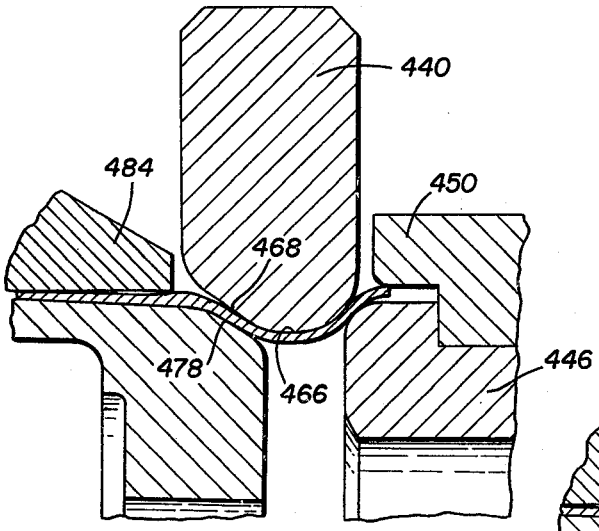
FIG. 12 is a view similar to FIG. 11, but during initial forming of the neck and flange of the can body.
Figure 13:
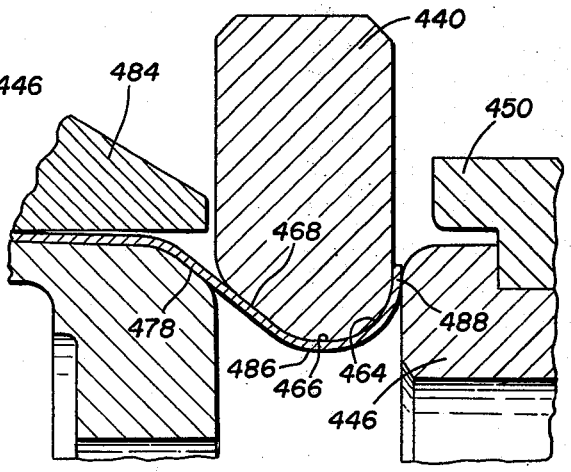
FIG. 13 is a view similar to FIG. 11, but in the final forming of the neck and flange in the can body.

With general reference to FIGS. *9a–c* and to the detailed FIGS. 11–13, the necking and flanging operation of the machine will be understood to involve the placement of an open ended container body 444 over the orbiting roller and the nose portion 446 of the pilot roller, with the open edge of the cylindrical container body nesting in the nest ring. A can holder ring 448 concentric with axis 324 and slightly larger in diameter than the intended outer diameter of the can body 444 circumferentially surrounds the can body immediately to the outside of the die ring, while the nest ring circumferentially surrounds the immediate free end of the container body and in cooperation with the pilot roller nose encapsulates the container free end. The nest ring has an axially protruding lip 450 forming the top of the encapsulating nest structure and the pilot roller has a cylindrical circumferential nose surface 452 forming the bottom of the structure. An end wall 454 between the lip 450 and surface 452 provides a stop for the container open end. The clearance between lip 450 and surface 452 is only slightly greater than the thickness of the container wall or about 0.015 inches, which may be fifty to seventh five percent of the anticipated container wall thickness. The closeness of the encapsulating nest clearance requires that the container fit over the pilot roller in good alignment with the nest, and the forward corner 456 of the pilot roller is therefore arcuate, for example of radius 0.015 inches, to guide and center the can onto the roller. The forward pilot roller surface 457 is radial.

The die ring 440, when in concentric position, has its inner radially extending face 458 in contact with the outer edge of the lip 450 to prevent unnecessary relative movement between the die and the nest ring or pilot roller. The outer face 460 of the die ring is also radial, and an operating face on the inner circumference of the ring joins the inner and outer faces. For convenience of description, the operating surface will be described from the inner face to the outer face with respect to the radius of the entire ring. In FIGS. 11–13, the inner face first angles at 462 radially inwardly and toward outer face 460 at a small angle such as 10 degrees from the radial face 458 and through a distance such as 0.0288 inches, after which a smooth curve 464 having radius 0.080 and arc of 80 degrees joins the surface 462 to cylindrical inner surface 466, having an axial dimension of about 0.035 inches. A relatively long surface 468 extends radially outwardly toward outer face 460 at about 35 degrees to the axis of the die, and this surface is joined smoothly to surface 466 by an arc 470 of 35 degrees and 0.08 inch radius, and to surface 460 by an arc 471 also having radius 0.08 inch. The die ring therefore has a relatively abrupt curve at its inner face but a more gentle curve toward the outer face.

The orbiting roller 412 has a cylindrical outer circumferential surface that tapers very slightly toward the pilot roller starting about 0.400 inches from the radial pilot roller contact face 472. For example, the surface 474 may angle radially inwardly at one degree from the axial in FIG. 11–13, creating a slight gap between surface 474 and the inner circumferential surface of the container body in FIG. 11. A slight curve 476 is initiated about 0.123 inches from face 472 as the roller surface curves radially inwardly through an arc of about 34 degrees with radius 0.120 inches, smoothly joining inwardly angling surface 478 having an inward angle of about 35 degrees from axial. The latter surface joins radial surface 472 with curve 480 of radius 0.050 inches.

During the operation of the tool, the orbiting roller is in concentric position when the can body is moved from the star wheel onto the pilot roller, after which the tool side cam causes the actuator rod to rotate by 180 degrees, which as previously described causes the orbiting roller to move to maximum eccentric position, shown in FIG. 11, wherein the container wall is supported on the cylindrical surfaces of both the pilot roller and orbiting roller. The tool side cam then causes more gradual rotation of the actuator rod to slowly bring the die ring into eccentric position. Due to the orbiting of the die ring and orbiting roller, the complete circumference of the container wall under the die ring is subjected to pressure and, as illustrated in FIG. 12, the die ring moves between the pilot roller and orbiting roller, causing the two rollers to move axially in opposite directions. The metal container wall is deformed between the orbiting roller and pilot roller, and initially, the free end of the wall is retained under nest ring lip 450, which serves to control the deformation of the end and prevent wrinkling. Some of the metal between the die surface 468 and the orbiting roller surface 478 reverse-flows toward the outer end of the tool assembly or to the left in FIG. 12.

Figure 10:
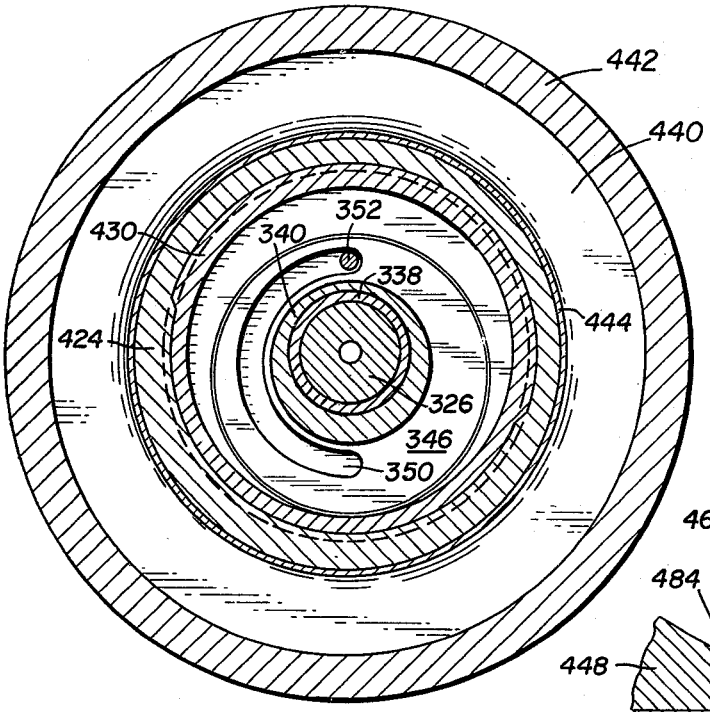
FIG. 10 is a cross-sectional view taken between the orbiting roller and pilot roller in FIG. 9*b*.

The can holder ring 448 provides bulge control and the slight taper of orbiting roller surface 474 creates an available space to receive the excess material without expanding the diameter of the can body. The interaction of surfaces 478 and 468 tends to iron the metal and cause the majority of flow into the area between the two rollers. The holder ring 474 is also of aid in encapsulating the container body and providing axial drag control for the container. The holder ring is radially free floating, for example on rubber O-ring mounts 482 that permit the holder ring to compensate for tool run-outs. In FIG. 10, the intended clearance between the orbiting roller, container wall, and holder ring is zero of less, with the resilience of the O-rings 482 allowing the ring to float radially for several thousandths of an inch when required by a less than zero clearance. The holder ring is tapered at its inner lip 484, which terminates immediately at the outer face of the die ring to provide a maximum degree of bulge control against reverse flow of metal.

In FIG. 12, the metal container wall is subjected to compressive forming between die ring surface 468 and orbiting roller surface 478, placing the metal in this area in a biaxial stress condition as the metal flows both axially and circumferentially with respect to the cylindrical container body. In FIG. 13, the orbiting roller and pilot roller have separated to the maximum degree and, correspondingly, the die ring has penetrated between these rollers to the maximum degree. The ironing of metal between surfaces 468 and 478 has ceased and the compressive stresses in the container wall are now minimized by reforming of the excess material under pure tensile stress, as the container wall is stretched over the tapered roller surface 474 and excess bulge is eliminated by the scissors-like action of the die ring and orbiting roller. The container wall has been shaped with necked-in portion 486 by the interaction of the orbiting roller and die ring, while the outwardly flanged portion 488 has been formed between the die ring and pilot roller. The flange terminates radially within the original outer diameter of the container body, permitting the container body to be withdrawn from the tool assembly without interfering with the can holder ring. The depth of the necked-in portion produces an inner diameter for the open end of the container that is larger than the diameter of the orbiting roller, so that the container will not interfere with the orbiting roller during withdrawal.

The tool side cam only gradually moves the die ring against the container wall in the sequence from FIG. 11 through FIG. 13. This permits the metal working process to take place over a series of orbits around axis 324. For example, twelve to sixteen orbits are desired between FIG. 11 and FIG. 13, and the die ring may remain in the position of the latter Fig. for three to five orbits to produce a high quality flange free of wrinkles. The reverse movement of the die ring and orbiting roller may be quite rapid in anticipation of container removal from the tool assembly.

When the container being necked and flanged is a beverage can, the can typically has been decorated on its exterior surface by an ink coating and covered on its interior surface by a protective coating. An important aspect of the machine 20 is that it does not cause scratching of these coatings. The can wall is not subjected to relative spinning motion with respect to any part of the tool assembly during insertion, necking and flanging operation, or removal. The can holder ring is non-rotating with respect to axis 324, as will be explained below, and the oribiting roller, pilot roller, and die ring are freewheeling with respect to the tool assembly and therefore are not required to rotate with mandrel 320. In the configuration of FIG. 9*a*, the orbiting roller and pilot roller are in axial abutment, and the die ring is frictionally contacting the nest ring, which is non-rotatably attached to the pilot roller. Thus, the two rollers and the die ring are in a frictionally connected unit that tends to rotate on axis 324 only because of bearing friction. Means are provided for overcoming bearing friction and are applied to the die ring or housing 396, resulting in the die ring and the frictionally connected rollers remaining in substantially stationary, non-rotating relationship to the mandrel axis 324, despite the rotation of the mandrel itself and bearing friction caused thereby.

Figure 9B:
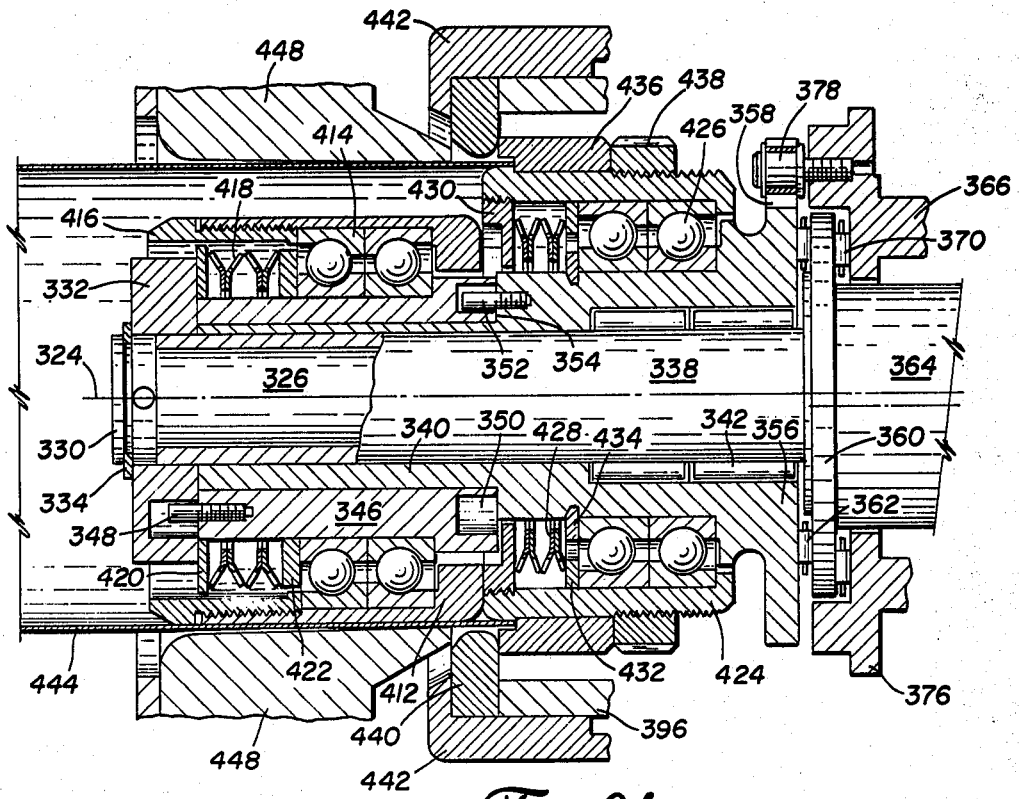
FIG. 9*b* is a partial view similar to FIG. 9*a*, showing the tool assembly after 180 degrees of actuation.

The container body is axially inserted over the orbiting roller when the tool assembly is in the configuration of FIG. 9*a*. As the tool assembly moves to the configuration of FIG. 9*b*, the orbiting roller retains abutting contact with the axially forward face of the pilot roller and therefore continues to be restrained from rotation caused by bearing friction. In the configuration of FIG. 9*b*, the cylindrical circumferential surface of the orbiting roller has contacted the inside surface of the container body and is holding the container body in a rotationally fixed position with respect to the holder ring. The container body is then serving as an additional means to prevent relative rotation in the orbiting roller and pilot roller. As the tool assembly moves into the configuration of FIG. 9c, the die ring will contact the exterior surface of the container body and, as it induces axial separation of the orbiting roller and pilot roller, the die ring will be free to roll without substantial slippage against the outer surface of the container body. The orbiting roller is also free to roll in this manner against the inside surface of the container body. Low friction coating materials may cover the container contact surfaces of the holder ring, orbiting roller and pilot roller to protect the container during relative axial motion with respect to those components.

Figure 14:
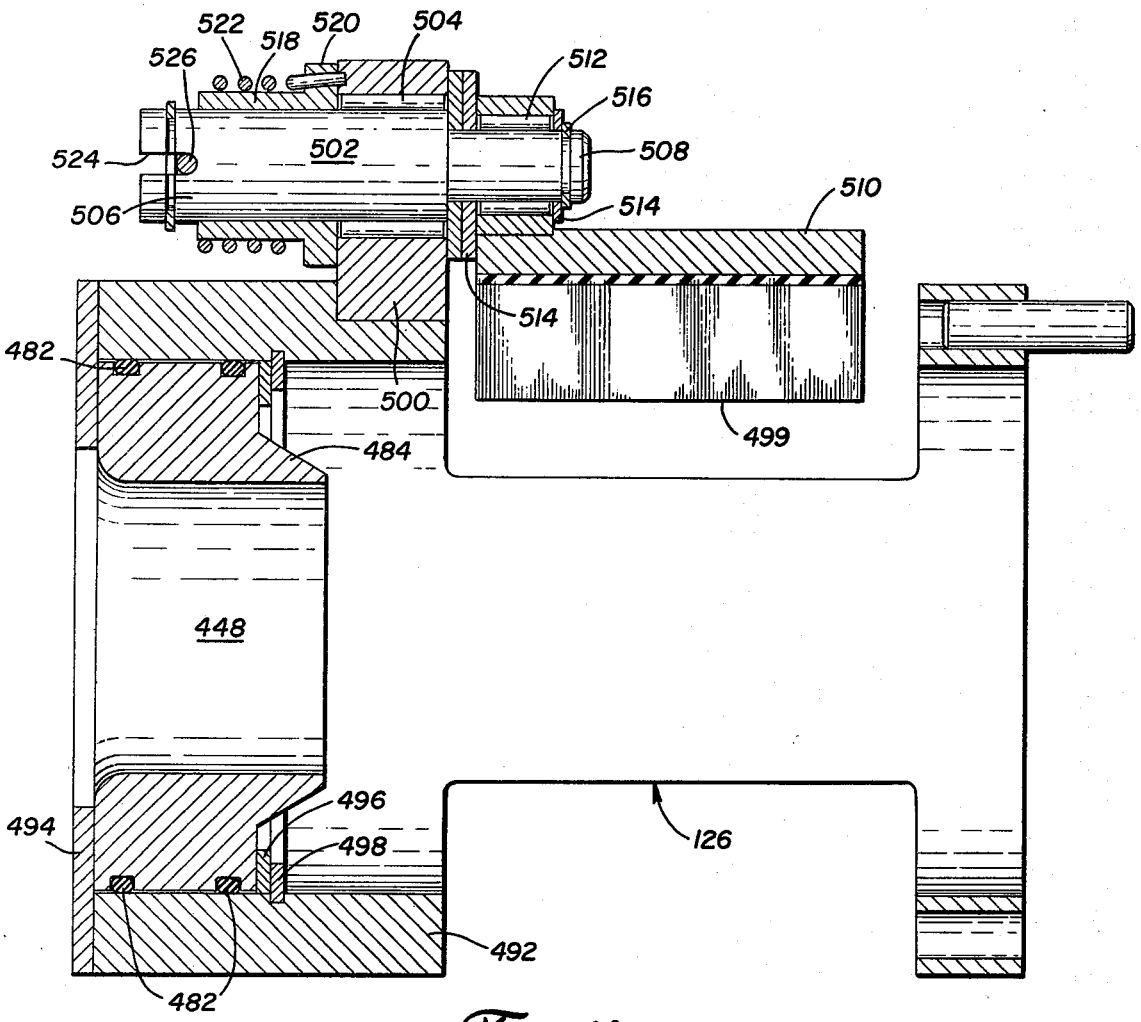
FIG. 14 is a side view of the drag brake assembly in partial section.

In FIG. 14, the means for overcoming bearing friction of the housing 396 is shown to be a drag brake assembly 126 that houses the can holder ring 448 in housing 492. A retainer disc 494 axially contains the can holder ring against a thrust washer 496 and retainer ring 498. The entire housing 492 is non-rotatably mounted on the spindle housing 96. As previously described, the tool assembly housing 396 at times has an orbital motion about axis 324, and it is necessary for the drag brake assembly 126 to accommodate this motion. The housing 492 is sufficiently large in inner diameter to permit the orbital motion, and brush 499 is supported against the tool assembly housing to overcome bearing friction. A pivot block 500 is fixed to the housing 492 and carries an eccentric pin 502 on roller bearings 504 supporting the portion 506 of the pin having a relatively greater diameter. The narrower nose 508 has its longitudinal axis offset from the axis of portion 506, and the nose carries brush holder 510 for rotation on bearings 512. Suitable thrust races 514 axially support the brush holder on the nose 508, and a retaining ring 516 clips over the free end of the nose. The opposite end of the eccentric pin carries an adjusting bushing 518 having a flanged end 520 adjacent to the pivot block. A torsion spring 522 circumferentially is carried on the body of the adjusting bushing. The free end of the pin portion 506 has a pair of perpendicular grooves 524 formed therein. Either groove may receive a first end 526 of the torsion spring, bent diametrically across the coil of the spring. The second spring end extends axially from the coil, through an axial opening or slot in the flange 520, and into a recess in the pivot block, where the second spring end anchors the spring against rotation with respect to the pivot block. The torsion spring biases the eccentric pin in one rotational direction. When the tool assembly housing is orbiting axis 324 in non-concentric position, the brush 499 is able to track the surface of the housing 396 through the rise and fall of pin nose 508 relative to the fixed axis of the pin portion 506, as resiliently biased by the torsion spring. Spring force is adjustable through selection of the slot 524 in which the spring end is placed.

Figure 9C:
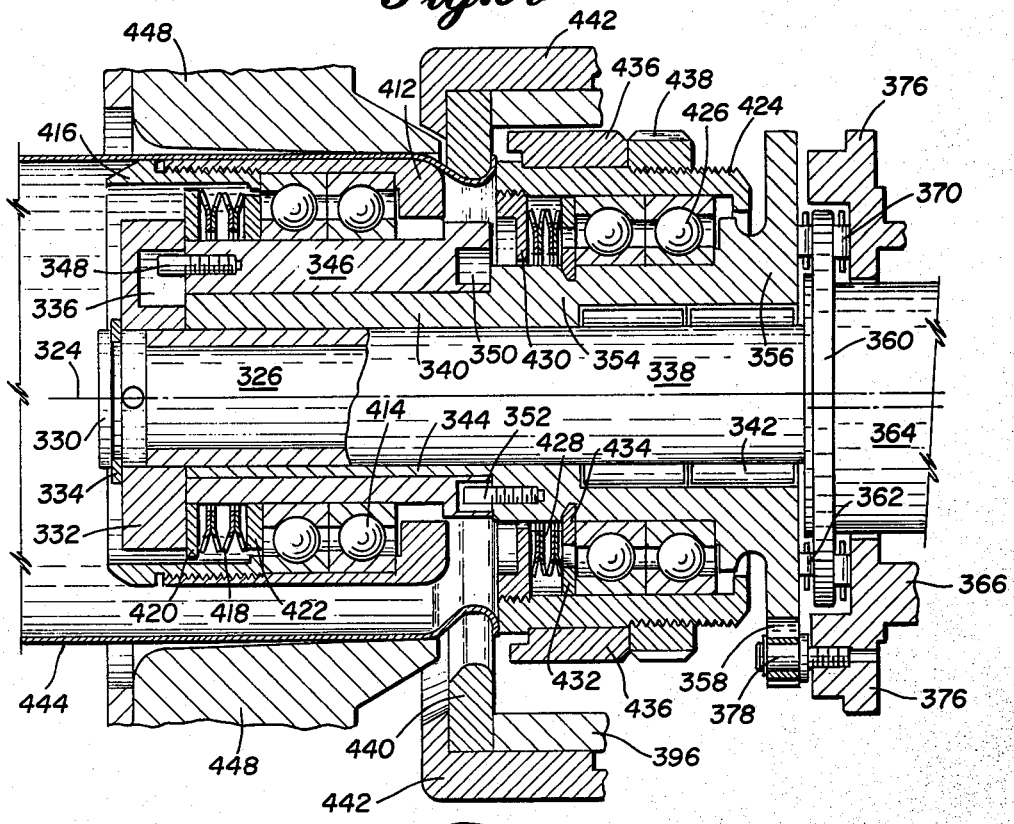
FIG. 9*c* is a partial view similar to FIG. 9*a*, showing the tool assembly after 360 degrees of actuation.

The overall operation of the machine 20 has the main shaft 36 in constant rotation as driven by the motor 24. The dome side ram turret 92, star wheels 116 and 118, spindle housing 96, and tool side ram turret 94 are in constant rotation with the main shaft. Container bodies from an external source are fed in a constant supply to the inlet track assembly 128, which deposits the container bodies consecutively in the star wheel pockets in a known fashion, with the dome side of each body axially facing a push plate assembly 114 and the open opposite axial end of each body axially facing a tool assembly 124. The spindle assemblies and tool assemblies are both orbiting the main shaft for rotation on their own axes because of the interaction of the pinion gear on each spindle assembly with the stationary bull gear 90. The dome side cam 86 and tool side cam 88 control respectively the axial position of each push plate assembly and the rotational configuration, as shown in FIGS. 9a–c, of each tool assembly. At the point where a container body is received in the star wheels, the corresponding axially aligned push plate assembly is fully retracted toward the dome side of the machine, and the tool assembly is in fully concentric position of FIG. 9a.

In the processing of a representative container body received in the star wheels, the dome side cam initiates movement of the corresponding dome side ram to move its push plate assembly toward the aligned tool assembly axially moving the container body into the tool assembly. The lip 156 on the can nest moves axially with the container body for continuously maintaining good axial alignment between the body and the tool assembly, although the body may slide with respect to tool side star wheel 118. Vacuum may be applied to the dome side of the body to hold the body in contact with the push plate. The container body easily passes over the orbiting roller in its concentric position and is guided into proper alignment with the pilot roller by the can holder ring. The axial end of the container body wall enters the encapsulating groove formed by the nest ring and strikes the nest ring end wall 454. If the container body has the exact axial length corresponding to the distance between the push plate 160 and the nest wall 454, the push plate would not be required to be resiliently biased toward the tool assembly; however, the machine anticipates a slight variation in axial body lengths and may be adjusted to bring the push plate to within the minimum acceptable body length distance of the nest wall 454, as by rotation of eccentric bushing 204 to control the distance of dome side ram travel. A decision may then be made as to whether it is desirable to have all flanged containers with identical flanges or whether it is more desirable to have all flanged containers with identical finished heights. The first alternative is believed to be the better choice, and consequently, the spring 166 biasing the push plate has a lower yield point than the spring means 428 biasing the pilot roller, with the result that when the container end strikes the nest end wall, the push plate will thereafter retreat into the can nest in preference to the pilot roller and nest ring moving axially toward the tool side cam. If the second alternative were preferred, the respective yield points of these springs could be reversed to produce containers with identical axial lengths to the finished flange.

The tool side cam may then cause the tool side ram to move toward the tool assembly, with the spindle assembly translating the linear motion of the ram into purely rotational motion that rotates the actuator rod to first move the orbiting roller rather rapidly into the position of FIG. 9b, and then to more gradually move the die ring to the position if FIG. 9c, after which the tool side ram retracts to restore the die ring to concentric position and then return the orbiting roller to concentric position.

The necking-in and flanging process occurring during these motions in the tool assembly have already been described in considerable detail in connection with FIGS. 11–13, but certain additional details might be noted. The orbiting roller is designed to have a smaller diameter than the finished inner diameter of the container neck to assure easy removal of the finished product from the tool assembly. The taper on the surface of the orbiting roller is designed to operate in coordination with the holder ring to receive reverse flowing metal during the necking process and to contain this metal to prevent bulging. The volume between the taper and holder ring anticipates a predetermined reverse flow, which would be determined by the material of the container wall, the configuration of the forming surfaces on the rollers and die ring, and the forming forces applied. In the figures previously supplied for the orbiting roller configuration, an aluminum can body having a nominal diameter of 2 and 11/16 inches, commonly known as a 211 can body, was anticipated, having a wall thickness at the marginal edge of the can body of between 0.006 and 0.009 inches. The orbiting roller taper might be larger or smaller than the one degree taper mentioned above. A useful range for beverage cans is between one-half degree and three degrees of taper, and the axial length of the taper before the forward forming surfaces of the orbiting roller, that is, before the roller areas acting directly opposite from the die ring, might be as short as one-tenth inch although a longer distance such as three-tenths is preferred. The container wall is pulled radially against the taper in the forming stages shown in FIGS. 12 and 13. An overly large taper might result in the cylindrical container wall being unable to spring back to the desired perfectly cylindrical shape after this stretching, while an overly small or no taper is likely to produce a radial bulge. The can holder ring optimally has almost no clearance with the outer surface of the container wall but in practice may have between 0.003 and 0.007 inch radial clearance outside the can wall. The closeness of the fit aids in metal control to prevent bulging.

The radial clearance between such a can body and the pilot roller might be approximately 0.002 inches on the average, or almost a line fit. On the outside of the marginal wall, the radial clearance with the nest ring might be 0.005 inches or a loose clearance. This outer clearance could be as much as twice the can wall thickness, although a slightly more snug clearance is preferred. The axial length of the can nest lip should be sufficient to contain the outward radial movement of the marginal edge at all times. The marginal edge is drawn toward the forward end of the tool assembly and is eventually drawn radially inwardly between the forward face of the pilot roller and the die ring. The nest ring is useful for its encapsulating function only until the radial inward movement of the marginal edge draws the edge out of contact with the nest ring. In practice, the nest ring may have a one-quarter inch lip for use with a 211 can body, and of this axial length, only about one-eighth inch is necessary for the encapsulating function.

The dished washer springs used to axially bias the orbiting roller and pilot roller are more suited to the requirements of controlled metal forming than are coil springs. A coil spring usually has a relatively linear graph of force versus deflection, while the dished washer springs with the radial slots formed therein as described above deflect relatively more with increasing force, producing a generally parabolic graph. This characteristic is highly desirable to attenuate the rate of increase of compressive forces in the later stages of the necking and flanging process, as at FIG. 13 where high compressive forces are not desired.

At the conclusion of the necking and flanging process, when the orbiting roller has been returned to concentric position, the container body is removed from the tool assembly by retraction of the dome side ram while vacuum is applied through the push plate, and, in addition, pressurized air applied through the actuator rod blows the can toward the push plate. In this manner, the container body is axially returned to the star wheels, where it may be discharged at the unloading track. During the entire process, the container body has avoided abrasive spinning interaction with machine 20.

I claim:

1. Apparatus for simultaneously necking-in and flanging the cylindrical side wall of a container body adjacent to an open axial end thereof, comprising:

(a) a mandrel having forward and rearward ends with a longitudinally extending axis of rotation extending therebetween;

(b) first roller means carried by the mandrel near the forward end thereof in axially slidable relationship for radially supporting the side wall of a container inserted over the first roller means;

(c) second roller means carried by the mandrel rearwardly of the first roller means in axially slidable relationship with the mandrel for radially supporting the side wall of a container inserted over at least a forward portion of the second roller means;

(d) can end nest means carried by the mandrel with at least a portion of the next means at a radial spacing outwardly from said forward portion of the second roller means for defining in combination with the forward portion of the second roller means a forwardly opening groove for receiving, in use, a container side wall marginal end and encapsulating the radial outer surface thereof; and (e) necking die means carried by said mandrel for radial movement in the plane between said first and second roller means for, in use, deforming the cylindrical side wall of a container inserted over said roller means while inducing axial separation of the two rollers to accommodate at least partial entry of the necking die means between the rollers.

2. The apparatus of claim 1, wherein said first roller means is of smaller diameter than the second roller means, further comprising first roller eccentric means carried by said mandrel for radially moving the first roller means between a first position substantially tangent to a common plane with the second roller means and a second position more concentric with the second roller means relative to the first position.

3. The apparatus of claim 2, wherein said first roller eccentric means comprises:

(a) an actuator rod passing axially through said mandrel and rotatable on said longitudinal axis of rotation;

(b) an eccentric bushing connected to the actuator rod, rotatable about said longitudinal axis of rotation, carried on the outer circumference of the mandrel, and supporting the first roller means on the outer circumference of the bushing; and (c) a pilot bushing radially intermediate the eccentric bushing and the mandrel and rotatable on said longitudinal axis with respect to both, at least the portion of the pilot bushing supporting the eccentric bushing being itself eccentric with respect to the longitudinal axis.

4. The apparatus of claim 3, wherein the eccentricity of the pilot bushing is substantially equal to the eccentricity of the eccentric bushing and substantially equal to one-half the difference between the radii of the first and second roller means.

5. The apparatus of claim 3, further comprising:

(a) an actuator disc connected to the actuator rod near the forward end thereof and extending radially therefrom;
(b) a first actuator pin extending forwardly from the edge of said eccentric bushing;
(c) said actuator disc having a radially elongated slot formed in the rear face thereof to receive the first actuator pin for transmitting rotational motion of the actuator rod to the eccentric bushing.

6. The apparatus of claim 5, further comprising a radially extending shoulder at the forward end of said actuator rod having at least one semi-cylindrical slot formed in the circumferential surface thereof and wherein said actuator disc comprises a central aperture sized to engage said shoulder, the circumferential surface defining the aperture having at least one semi-cylindrical slot complimentary to the slot of the shoulder; and a dowel pin engagable in the two slots when aligned for keying the rod and disc together.

7. The apparatus of claim 1, wherein said can nest means comprises an annular nest ring concentric with said second roller means and having a forwardly extending annular shoulder spaced radially outwardly from the circumferential surface of the second roller means forward portion to define said can wall receiving groove in an annular shape; and wherein said necking die means comprises an annular die having an inner diameter approximately at least as large as the outer diameter of the annular can receiving groove.

8. The apparatus of claim 7, intended to operate on container bodies of initially substantially predetermined side wall thickness, wherein said annular groove has a radial dimension of substantially between 150% and 200% of the predetermined container body side wall thickness to be engaged therein.

9. The apparatus of claim 1, wherein said necking die means is a ring die carried for freewheeling rotation on said mandrel, and further comprising ring die eccentric support means for radially moving the ring die between a first position substanially concentric with said longitudial axis and a second position radially offset from said concentric first position.

10. The apparatus of claim 9, wherein said necking die eccentric support means further comprises an eccentric hub carrying the ring die for relative rotation on the outer surface thereof; and an eccentric hub-support portion of said mandrel carrying the eccentric hub for relative rotation thereon.

11. The apparatus of claim 10, wherein the eccentricity of the eccentric hub is substantially equal to the eccentricity of the eccentric hub-support mandrel portion for permitting the hub to be concentric with the longitudinal axis when the eccentrics are in offsetting rotational positions.

12. The apparatus of claim 10, further comprising detent means carried by the eccentric hub and eccentric hub-support mandrel portion for resisting unauthorized relative rotation therebetween.

13. The apparatus of claim 12, wherein the detent means comprises a ball plunger carried by the eccentric hub and a mating recess in the eccentric hub-support mandrel portion in relative positions to be engaged with the high points of both eccentrics are rotationally aligned.

14. Apparatus for simultaneously necking-in and flanging the cylindrical side wall of a container body adjacent to an open axial end thereof, comprising:
(a) a mandrel having a longitudinal axis of rotation extending between forward and rearward ends thereof, said mandrel having a concentric outer circumferential forward surface and an eccentric outer circumferential rearward surface and an axial bore through said longitudinal axis;
(b) an actuator rod carried in said mandrel bore and rotatable therein with respect to the mandrel;
(c) a pilot bushing carried rotatably on said concentric forward mandrel surface, the pilot bushing having an eccentric outer circumferential forward surface and a concentric outer circumferential rearward surface;
(d) an eccentric hub carried rotatably on said eccentric rearward mandrel surface;
(e) means for joining the pilot bushing to the eccentric hub with the high points of the respective eccentrics at 180 degree opposite rotational positions;
(f) an eccentric bushing carried rotatably on the eccentric forward surface of the pilot bushing;
(g) a first roller carried rotatably and axially slidably on the outer circumference of the eccentric bushing;
(h) means joining the actuator rod to the eccentric bushing for transmitting the rotation of the rod to the bushing;
(i) a second roller carried rotatably and axially slidably on the outer circumferential rearward surface of the pilot bushing;
(j) means joining the eccentric bushing to the pilot bushing for transmitting rotation between said bushings with a predetermined angular arc of non-transmission; and
(k) an annular die ring carried rotatably on said eccentric hub in a plane normal to said longitudinal axis and between said first and second rollers.

15. The apparatus of claim 14, wherein said means joining the eccentric bushing to the pilot bushing comprises an arcuate slot of said predetermined angular length in one of said bushings and an actuator pin slidably engaged in the slot and connected to the other of said bushings.

16. The apparatus of claim 14, further comprising means for imparting rotation to said mandrel about the longitudinal axis thereof.

17. The apparatus of claim 16, further comprising means for imparting rotation to said actuator rod relative to the rotation of the mandrel.

18. The apparatus of claim 17, further comprising a machine housing carrying said mandrel for rotation with respect thereto and a drag brake assembly carried by the housing in non-rotatable relationship with respect thereto, said drag brake assembly having a drag imparting member acting to resist rotation of said ring die with respect to the drag brake assembly.

19. The apparatus of claim 18, further comprising means for maintaining operative connection between the drag imparting member and the ring die during rotation of the mandrel when the ring die is eccentric with respect to the longitudinal axis thereof.

20. The apparatus of claim 19, wherein said drag brake assembly further comprises a drag brake housing connected to said machine housing, and said means for maintaining contact with the ring die comprises:
(a) an eccentric pin having a first cylindrical pin portion with a defined axis of rotation and a second cylindrical pin portion having an axis of rotation offset to the first pin portion axis;

(b) a pivot block carried by the drag brake housing and in turn carrying said eccentric pin for rotation on said first pin portion axis;

(c) resilient means for torsionally biasing said eccentric pin to rotate in a single direction about the first pin portion axis;

(d) holder means for said drag imparting member mounted for rotation on the second pin portion axis for applying the drag imparting member in operative resiliently biased connection to the ring die.

21. The apparatus of claim 14, further comprising resilient means biasing said first roller toward the second roller with force increasing at less than a linear rate with increasing separation of the rollers.

22. The apparatus of claim 14, further comprising resilient means biasing said second roller toward the first roller with force increasing at less that a linear rate with increasing separation of the rollers.

23. The apparatus of claim 14, further comprising first resilient means biasing said first roller toward the second roller with force increasing at less than a linear rate with increasing separation of the rollers, and second resilient means biasing said second roller toward the first roller with force increasing at less than a linear rate with increasing separation of the rollers, said first and second resilient means each comprising a plurality of dished spring washers having radial slots formed in the outer edge thereof to define radial fingers, said washers arranged concave to concave side and convex to convex side.

24. The apparatus of claim 14, further comprising an antifriction solid coating on the outer circumferential surface of said first roller and second roller for permitting, in use, axial motion between the rollers and a container body.

25. The apparatus of claim 14, further comprising an antifriction solid coating on the outer circumference of said eccentric bushing and on the outer circumference of said pilot bushing.

26. Apparatus for simultaneously necking-in and flanging the cylindrical side wall of a container body of predetermined inner and outer radius adjacent to an open axial end thereof, comprising:

(a) roller supporting mandrel means having a forward and rearward end with a longitudinal axis extending therebetween;

(b) first container wall supporting roller means carried by said mandrel for rotation and axial movement on an axis parallel to said longitudinal axis, the first roller means having an outer radius substantially smaller than the predetermined inner radius of a container body for receiving a container body thereover;

(c) second container wall supporting roller means carried by said mandrel for rotation and axial movement on said longitudinal axis, the second roller means having an outer radius at the forward end thereof substantially similar to the predetermined inner radius of a container body for supporting a container body;

(d) an annular ring die carried by said mandrel for freewheeling rotation and radial movement in a plane normal to the longitudinal mandrel axis from a position wherein the inner circumference of the ring die is outside the predetermined container wall outer radius distance from said mandrel axis to a position wherein a point of the inner circumference of the ring die is inside the predetermined container wall inner radius distance of the mandrel axis, and axially displacing the first and second roller means in opposite directions;

(e) annular container wall holder means substantially concentric with said longitudinal mandrel axis and having an inner radius substantially equal to the predetermined outer radius of a container body, overlying the circumference of the first roller means through an axial distance extending forwardly from approximately the forward wall of said ring die;

(f) the outer circumference of the first roller means having a rearward and radially inward taper to create in combination with the container wall holder means a volume for receiving container wall material displaced by interaction of the ring die with the first and second roller means and the container wall to prevent bulging and spring-back beyond original diameter of the container wall during axial displacement of the roller means by the ring die.

27. The apparatus of claim 26, further comprising resilient means holding said container wall holder means in floating radial relationship to said mandrel to accommodate variations in actual container wall thicknesses.

28. The apparatus of claim 26, further comprising means for circumferentially encasing a container wall immediately adjacent to the open end thereof telescoped over said second roller means against unrestricted radial outward movement during radial inward movement of said ring die relative to the mandrel axis.

29. The apparatus of claim 28, wherein said encasing means comprises an annular shoulder at a radial spacing from the outer circumferential surface of the second roller means of no more than 200% of the predetermined container wall thickness to be contained therein.

30. The apparatus of claim 29, wherein said annular shoulder has an axial length at least sufficient to contain the container wall end against outward radial deformation past the inner circumference of the shoulder during any portion of radial inward movement of the ring die.

31. The apparatus of claim 29, wherein said radial spacing from the second roller means is substantially between 150% and 175% of the predetermined container wall thickness.

32. The apparatus of claim 26, wherein the container wall has a radial thickness of less than 0.012 inches and the first roller means taper is between one-half and three degrees over an axial distance greater than one-tenth of an inch.

33. Apparatus for simultaneously necking-in and flanging the cylindrical side wall of a container body adjacent to an open axial end thereof, comprising:

(a) a machine base;

(b) an axially extending main shaft carried for rotation on said base;

(c) means for driving said main shaft;

(d) first cam means carried by the machine base for operating container push plate assemblies;

(e) a first ram turrent carrying a plurality of axially movable first rams spaced circumferentially equally thereon;

(f) a first cam follower assembly connected to a first end of each said first ram and operatively connected to the first cam means;

(g) a container push plate assembly connected to the second end of each of said first rams;

(h) a star wheel connected for rotation with the main shaft and having a container receiving pocket axially aligned with each of said push plate assemblies;
(i) second cam means carried by the machine base for operating necking and flanging tool assemblies;
(j) a second ram turret carrying a plurality of axially movable second rams spaced circumferentially equally thereon;
(k) a second cam follower assembly connected to a first end of each said second ram and engaging the second cam means;
(l) spindle means for converting axial motion of each said second ram into pure rotational motion, said spindle means being connected to a second end of each second ram, each spindle means having an axis of rotation parallel to the axis of the main shaft;
(m) means for imparting secondary rotation to each spindle means about its own axis in response to the rotation of the main shaft;
(n) a tool assembly for necking and flanging the side wall of a container body connected to each spindle means and axially aligned with a pocket of said star wheel on the side opposite from said can push plate assembly, the tool assembly having a first connecting means to the spindle for transmitting the secondary rotation of the spindle to the tool assembly and a second connecting means to the spindle for transmitting converted linear-to-rotational motion to the tool assembly;
(o) container body infeed means for delivering a supply of container bodies to the star wheel; and
(p) container body discharge means for removing necked and flanged container bodies from the star wheel.

34. The apparatus of claim 33, wherein said first cam means is carried on said main shaft for relative rotation therewith, and further comprising adjustable retaining means for holding the first cam means in a selected fixed position with respect to the machine base.

35. The apparatus of claim 33, wherein said first and second rams each comprise a pair of mutually eccentric cylindrical portions, and further comprising a ram cartridge having a double eccentric cylindrical bore adapted to mate with both eccentric portions of the ram to permit axial motion without rotation, each ram cartridge being connected to one of said ram turrets.

36. The apparatus of claim 33, wherein each cam follower assembly comprises:
(a) a cam follower having an axial shaft rotatably supporting the follower,
(b) an eccentric bushing connected to the shaft;
(c) a cam follower holder having means on a first end thereof for engaging a ram end and having a split aperture near the opposite end for engaging said eccentric bushing by circumferentially applied friction;
(d) a tongue clampable axially, with respect to the cam follower shaft, against the eccentric bushing and fastened to the cam follower holder to further resist unauthorized rotation of the eccentric bushing.

37. The cam follower assembly of claim 36, wherein said eccentric bushing comprises an annular axially protruding tapered ridge and said tongue has formed therein an arcuate tapered groove mating with said ridge in clamped relationship.

38. The cam follower assembly of claim 36, wherein said ram end engaging means comprises a double eccentric bore for engaging a mating double eccentric ram end.

39. The apparatus of claim 33, wherein said container push plate assembly comprises:
(a) a container nest having a container end receiving recess in the side of the nest axially facing the tool assembly;
(b) a container push plate axially slidable in the container nest recess; and
(c) resilient means for biasing the push plate toward the tool assembly but yielding at a first predetermined yield force to allow the push plate to retreat axially into the nest.

40. The apparatus of claim 39, further comprising an arcuate lip axially protruding toward the tool assembly from the push plate assembly and axially moveable with said first ram for supporting a container body during axial movement.

41. The apparatus of claim 39, wherein said tool assembly further comprises:
(a) container nest ring means axially aligned with each of said push plate assemblies and axially slidable with respect thereto for receiving the marginal axial end of a container side wall in axial abutting relationship against a portion of the nest ring means; and
(b) resilient means for biasing said nest ring means toward the push plate assembly but yielding at a second predetermined yield force to allow the nest ring means to move axially opposite to the push plate assembly.

42. The apparatus of claim 41, wherein said first predetermined yield force of the push plate resilient means is smaller than said second predetermined yield force of the nest ring means for assuring that a uniform axial length of the container side wall is received in the tool assembly.

43. The apparatus of claim 41, wherein said nest ring resilient means comprises a plurality of dished washer springs having radial slots for attenuating spring force and arranged concave to concave side and convex to convex side.

44. The apparatus of claim 33, wherein said spindle means comprises:
(a) a spindle body having a central axis with an axial bore parallel to the axis of said main shaft and carried for orbital rotation with the main shaft;
(b) an actuating screw carried in said spindle bore for rotation and axial movement;
(c) a ball nut riding on the actuating screw for relative rotation in response to axial motion of the screw;
(d) means for retaining the ball nut non-rotatably in the spindle body;
(e) a coupler pin connected to one end of the actuating screw non-rotatably with respect to the screw and carried in the spindle body bore for axial movement with the screw;
(f) a coupler bushing carried in the spindle body bore rotatably with respect to the bore and substantially non-axially moveable therein;
(g) means joining the coupler pin to the coupler bushing for transmitting rotation of the pin to the bushing;
(h) means for joining one of said second rams to the actuating screw, said means connected to the screw for free rotation and without substantial axial movement with respect thereto.

45. The apparatus of claim 44, further comprising a spindle housing carrying said spindle means, connected to the main shaft for rotation therewith; and bearing means carrying the spindle body for rotation on said spindle body axis with respect to the housing.

46. The apparatus of claim 45, wherein said means for imparting secondary motion to each spindle comprises a pinion gear connected non-rotatably to each spindle body and a bull gear connected substantially non-rotatably to the machine base and engaging the pinion gears.

47. The apparatus of claim 44, wherein said first tool assembly connecting means comprises a mandrel connected to said spindle body for rotation therewith, and said second tool assembly connecting means comprises an actuator rod carried rotatably in said mandrel and connected to said coupler bushing for rotation therewith.

48. The apparatus of claim 44, wherein said means joining the coupler pin to the coupler bushing comprise axially extending mating semi-cylindrical bearing races on the exterior circumference of the coupler pin and the interior circumference of the coupler bushing, and balls contained in said races.

49. The apparatus of claim 44, further comprising a hydraulic bushing mounted in said spindle body for radially self-aligning connection to said tool assembly.

50. The method of simultaneously necking-in and flanging the cylindrical side wall of a container body adjacent to an open axial end thereof, comprising:

(a) axially telescoping said container over a first roller of smaller diameter than the inner diameter of the container;

(b) further axially moving the container telescopically at least partially over a second roller concentric with said first roller and of similar diameter to the interior diameter of the container for approximate alignment of the container axis with the second roller axis and engaging the end of the container side wall in an annular groove circumferentially encapsulating the end portion of the side wall under an annular nest ring associated with the second roller;

(c) moving said first roller radially to a position of tangency with the interior of the container side wall;

(d) radially moving a ring die of larger inner diameter than the outer diameter of the container side wall from a position concentric with said second roller to a position eccentric with respect thereto and contacting the outer surface of the container side wall substantially at the line of tangency with said first roller;

(d) orbiting the ring die and first roller about the axis of the second roller to induce rolling without substantial slippage of the die and first roller against the container side wall while increasing the eccentricity of the ring die position with respect to said axis, the ring die inducing the first and second rollers to move axially in opposite directions while deforming the container wall between the rollers, said nest ring containing the edge of the container side wall against radial spreading beyond the inner circumference of the nest ring;

(f) further increasing the eccentricity of the ring die with respect to the second roller axis to draw the edge of the container wall between the axially facing surfaces of the second roller and ring die while tensioning the container wall material between the axially facing surface of the ring die and first roller;

(g) radially moving the ring die to concentric position with respect to the second roller axis;

(h) radially moving the first roller to concentric position with respect to the second roller axis; and (i) axially withdrawing the container body from the first and second rollers;

51. The method of claim 50, further comprising while performing said ring die orbiting step, encapsulating the container wall material circumferentially surrounding the first roller under an annular holder ring having an inner diameter substantially equal to the outer diameter of the container side wall to prevent radial bulging of the container wall because of wall material flowing axially toward the first roller from the position of the ring die.

52. The method of simultaneously necking-in and flanging the cylindrical side wall of a metal container body in the marginal portion thereof adjacent an open axial end of the body, comprising:

(a) initially radially relatively displacing a die member outside the container body and a pair of axially movable container wall support members inside the container body to interpose a portion of the outer die member between the inner support members and to cause axial separation of the inner support members while compressing a portion of the container side wall between the die member and the two support members; and (b) further radially relatively displacing the die member and the two support members without further substantially axially separating the support members to further deform the container side wall under substantially pure tensile forces.

53. The method of claim 52, comprising radially encapsulating the end edge of the cylindrical container body side wall immediately adjacent to the open end thereof to prevent radial outward movement of the end edge beyond a predetermined distance.

54. The method of claim 53, wherein said predetermined distance is twice the radial thickness of the container side wall at said end edge.

55. The method of claim 53, further comprising encapsulating the container body side wall on the axially opposite side of the outer die member from said open end between an outer member and one of said inner members having an axial taper toward the open end of the container body for receiving and containing metal displaced during said initial compressive step and yielding at least part of said received metal during said tensioning step.

56. An apparatus for converting linear motion into rotational motion, for use in a machine having a linearly moving element, wherein the apparatus comprises:

(a) a spindle body having a central axis with an axial bore;

(b) an actuating screw carried in said spindle bore for rotation and axial movement;

(c) a ball nut riding on the actuating screw for relative rotation in response to axial motion of the screw;

(d) means for retaining the ball nut non-rotatably in the spindle body;

(e) a coupler pin connected to one end of the actuating screw non-rotatably with respect to the screw and carried in the spindle body bore for axial movement with the screw;

(f) a coupler bushing carried in the spindle body bore rotatably with respect to the bore and substantially non-axially movable therein; and (g) means joining the coupler pin to the coupler bushing for transmitting rotation of the pin to the bushing, the bushing providing a source of rotational motion in response to linear motion applied to said actuating screw by the linearly moving machine element.

57. The apparatus of claim 56, wherein said means for joining the coupler pin to the coupler bushing comprise axially extending mating semi-cylindrical bearing races on the exterior circumference of the coupler pin and the interior circumference of the coupler bushing, and balls contained in said races.

* * * * *